US008886499B2

(12) United States Patent
Matsumoto

(10) Patent No.: US 8,886,499 B2
(45) Date of Patent: Nov. 11, 2014

(54) VOICE PROCESSING APPARATUS AND VOICE PROCESSING METHOD

(71) Applicant: Fujitsu Limited, Kawasaki (JP)

(72) Inventor: Chikako Matsumoto, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 220 days.

(21) Appl. No.: 13/659,410

(22) Filed: Oct. 24, 2012

(65) Prior Publication Data

US 2013/0166286 A1 Jun. 27, 2013

(30) Foreign Application Priority Data

Dec. 27, 2011 (JP) ..... 2011-286450

(51) Int. Cl.
*G10L 19/02* (2013.01)

(52) U.S. Cl.
USPC ..... 703/3; 381/94.2

(58) Field of Classification Search
USPC ..... 704/200–230, 500–504; 381/92, 94.2, 381/97
See application file for complete search history.

(56) References Cited

U.S. PATENT DOCUMENTS

| | | | | |
|---|---|---|---|---|
| 7,970,609 | B2 * | 6/2011 | Hayakawa | 704/238 |
| 8,036,888 | B2 | 10/2011 | Matsuo | |
| 8,073,690 | B2 * | 12/2011 | Nakadai et al. | 704/233 |
| 8,194,861 | B2 * | 6/2012 | Henn et al. | 381/22 |
| 8,352,274 | B2 * | 1/2013 | Yoshizawa et al. | 704/270 |
| 8,565,445 | B2 * | 10/2013 | Matsuo | 381/92 |
| 2006/0204019 | A1 * | 9/2006 | Suzuki et al. | 381/92 |
| 2009/0066798 | A1 * | 3/2009 | Oku et al. | 348/207.99 |

FOREIGN PATENT DOCUMENTS

| | | |
|---|---|---|
| JP | 2003-078988 | 3/2003 |
| JP | 2007-318528 | 12/2007 |
| JP | 2010-176105 | 8/2010 |
| JP | 2011-033717 | 2/2011 |
| JP | 2011-099967 | 5/2011 |

* cited by examiner

*Primary Examiner* — Abul Azad
(74) *Attorney, Agent, or Firm* — Fujitsu Patent Center

(57) ABSTRACT

A voice processing apparatus includes: a phase difference calculation unit which calculates for each frequency band a phase difference between first and second frequency signals obtained by applying a time-frequency transform to sounds captured by two voice input units; a detection unit which detects a frequency band for which the percentage of the phase difference falling within a first range that the phase difference can take for a specific sound source direction, the percentage being taken over a predetermined number of frames, does not satisfy a condition corresponding to a sound coming from the direction; a range setting unit which sets, for the detected frequency band, a second range by expanding the first range; and a signal correction unit which makes the amplitude of the first and second frequency signals larger when the phase difference falls within the second range than when the phase difference falls outside the second range.

18 Claims, 12 Drawing Sheets

FIG.7

| FREQUENCY BAND / SUB-DIRECTION RANGE | 1 | 2 | … | 30 | 31 | 32 | … | 127 | 128 |
|---|---|---|---|---|---|---|---|---|---|
| (1) | 0.05 | 0.01 | | 0.1 | 0.07 | 0.19 | | 0.07 | 0.12 |
| (2) | 0.05 | 0.06 | | 0.13 | 0.07 | 0.14 | | 0.18 | 0.28 |
| (3) | 0.1 | 0.05 | | 0.05 | 0.18 | 0.66 | | 0.71 | 0.68 |
| (4) | 0.05 | 0.01 | | 0.1 | 0.07 | 0.19 | | 0.08 | 0.13 |
| (5) | 0.1 | 0.01 | | 0.32 | 0.55 | 0.1 | | 0.1 | 0.07 |
| (6) | 0.06 | 0.09 | | 0.46 | 0.45 | 0.08 | | 0.05 | 0.05 |
| AVMAXARP | 0.0683 | 0.0383 | | 0.1933 | 0.2317 | 0.2267 | | 0.1983 | 0.2217 |
| VMAXARP | 0.0005 | 0.0009 | | 0.0215 | 0.0383 | 0.0393 | | 0.0540 | 0.0474 |

701

702

700

VOICE PROCESSING APPARATUS AND VOICE PROCESSING METHOD

CROSS-REFERENCE TO RELATED APPLICATION

This application is based upon and claims the benefit of priority of prior Japanese Patent Application No. 2011-286450, filed on Dec. 27, 2011, the entire contents of which are incorporated herein by reference.

FIELD

The embodiments discussed herein are related to a voice processing apparatus and a voice processing method which, of the voices captured by a plurality of microphones, make a voice coming from a specific direction easier to hear.

BACKGROUND

Recent years have seen the development of voice processing apparatuses, such as teleconferencing systems or telephones equipped with hands-free talking capability, that capture voices by using a plurality of microphones. For such voice processing apparatuses, developing technologies for suppressing voice coming from any direction other than a specific direction and thereby making voice coming from the specific direction easier to hear has been proceeding.

For example, Japanese Laid-open Patent Publication No. 2007-318528 discloses a directional sound-capturing device which converts a sound received from each of a plurality of sound sources, each located in a different direction, into a frequency-domain signal, calculates a suppression function for suppressing the frequency-domain signal, and corrects the frequency-domain signal by multiplying the amplitude component of the frequency-domain signal of the original signal by the suppression function. The directional sound-capturing device calculates the phase components of the respective frequency-domain signals on a frequency-by-frequency basis, calculates the difference between the phase components, and determines, based on the difference, a probability value which indicates the probability that a sound source is located in a particular direction. Then, the directional sound-capturing device calculates, based on the probability value, a suppression function for suppressing the sound arriving from any sound source other than the sound source located in that particular direction.

On the other hand, Japanese Laid-open Patent Publication No. 2010-176105 discloses a noise suppressing device which isolates sound sources of sounds received by two or more microphones and estimates the direction of the sound source of the target sound from among the thus isolated sound sources. Then, a noise suppressing device detects the phase difference between the microphones by using the direction of the sound source of the target sound, updates the center value of the phase difference by using the detected phase difference, and suppresses noise received by the microphones by using a noise suppressing filter generated using the updated center value.

Japanese Laid-open Patent Publication No. 2011-99967 discloses a voice signal processing method which identifies a voice section and a noise section from a first input voice signal and determines whether the magnitude of power of the first input voice signal in the noise section is larger than a first threshold value. When the magnitude of power of the first input voice signal is not larger than the first threshold value, the voice signal processing method suppresses noise in the voice section and noise section of the first input voice signal, based on the magnitude of power in the noise section. On the other hand, when the magnitude of power of the first input voice signal is larger than the first threshold value, the voice signal processing method suppresses the first input voice signal based on the phase difference between the first and second input voice signals.

Further, Japanese Laid-open Patent Publication No. 2003-78988 discloses a sound collecting device which divides two-channel sound signals captured by microphones into a plurality of frequency bands on a frame-by-frame basis, calculates a level or phase for each channel and for each frequency band, and calculates weighted averages of the levels and phases over a plurality of frames from the past to the present. Then, based on the difference in weighted average level or phase between the channels, the sound collecting device identifies the sound source to which the corresponding frequency band component belongs, and combines the frequency band component signals identified as belonging to the same sound source between the plurality of frequency bands.

On the other hand, Japanese Laid-open Patent Publication No. 2011-33717 discloses a noise suppressing device which calculates a cross spectrum from sound signals captured by two microphones, measures the variation over time of the phase component of the cross spectrum, and determines that a frequency component having a small variation is a voice component and a frequency component having a large variation is a noise component. Then, the noise suppressing device calculates such a correction coefficient so as to suppress the amplitude of the noise component.

However, depending on the difference in characteristics between the individual microphones used to capture the sounds or on the environment where the microphones are installed, the phase difference actually measured between the sounds received by the respective microphones from the sound source located in the specific direction may not necessarily agree with the theoretical value of the phase difference. As a result, the direction of the sound source may not be correctly estimated. Therefore, in any of the above prior art, the sound desired to be enhanced may be mistakenly suppressed or conversely, the sound to be suppressed may not be suppressed.

SUMMARY

According to one embodiment, a voice processing apparatus is provided. The voice processing apparatus includes: a time-frequency transforming unit which transforms a first voice signal representing a sound captured by a first voice input unit and a second voice signal representing a sound captured by a second voice input unit, respectively, into a first frequency signal and a second frequency signal in a frequency domain on a frame-by-frame basis with each frame having a predefined time length; a phase difference calculation unit which calculates a phase difference between the first frequency signal and the second frequency signal on the frame-by-frame basis for each of a plurality of frequency bands; a detection unit which determines on the frame-by-frame basis for each of the plurality of frequency bands whether or not the phase difference falls within a first range of phase differences that the phase difference can take for a specific sound source direction, thereby obtaining the percentage of the phase difference falling within the first range over a predetermined number of frames, and which detects, from among the plurality of frequency bands, a frequency band for which the percentage does not satisfy a condition corresponding to a sound coming from the sound source direction; a range setting unit which sets, for the frequency band detected by the detection unit, a second range by expanding the first range predefined for the sound source direction; a signal correction unit which produces corrected first and second frequency signals by making the amplitude of at least one of the first and second frequency signals larger when the phase difference falls within the second range than when the phase difference falls outside the second range; and a frequency-time transforming unit which transforms the corrected first and second frequency signals, respectively, into corrected first and second voice signals in a time domain.

The object and advantages of the invention will be realized and attained by means of the elements and combinations indicated in the claims.

It is to be understood that both the foregoing general description and the following detailed description are exemplary and explanatory and are not restrictive of the invention, as claimed.

BRIEF DESCRIPTION OF DRAWINGS

FIG. 7 a diagram illustrating a table depicting by way of example the maximum value, average value, and variance of the achieved rate obtained on a frequency-band by frequency-band basis.

DESCRIPTION OF THE EMBODIMENTS

Various embodiments of a voice processing apparatus will be described below with reference to the drawings. The voice processing apparatus obtains for each of a plurality of frequency bands the phase difference between the voice signals captured by a plurality of voice input units, estimates the direction of a specific sound source from the phase difference obtained for each frequency band, and attenuates the voice signal arriving from any direction other than the direction of that specific sound source. At this time, the voice processing apparatus calculates for each frequency band the percentage of the phase difference falling within the phase difference range corresponding to the target sound source over the immediately preceding period of a predetermined length. Then, for any particular frequency band for which the percentage is low, the voice processing apparatus expands the phase difference range in which the voice signal is not to be attenuated, by assuming that the phase difference is varying due to the difference in characteristics between the individual microphones or due to the environment where the microphones are installed.

Figure 1:
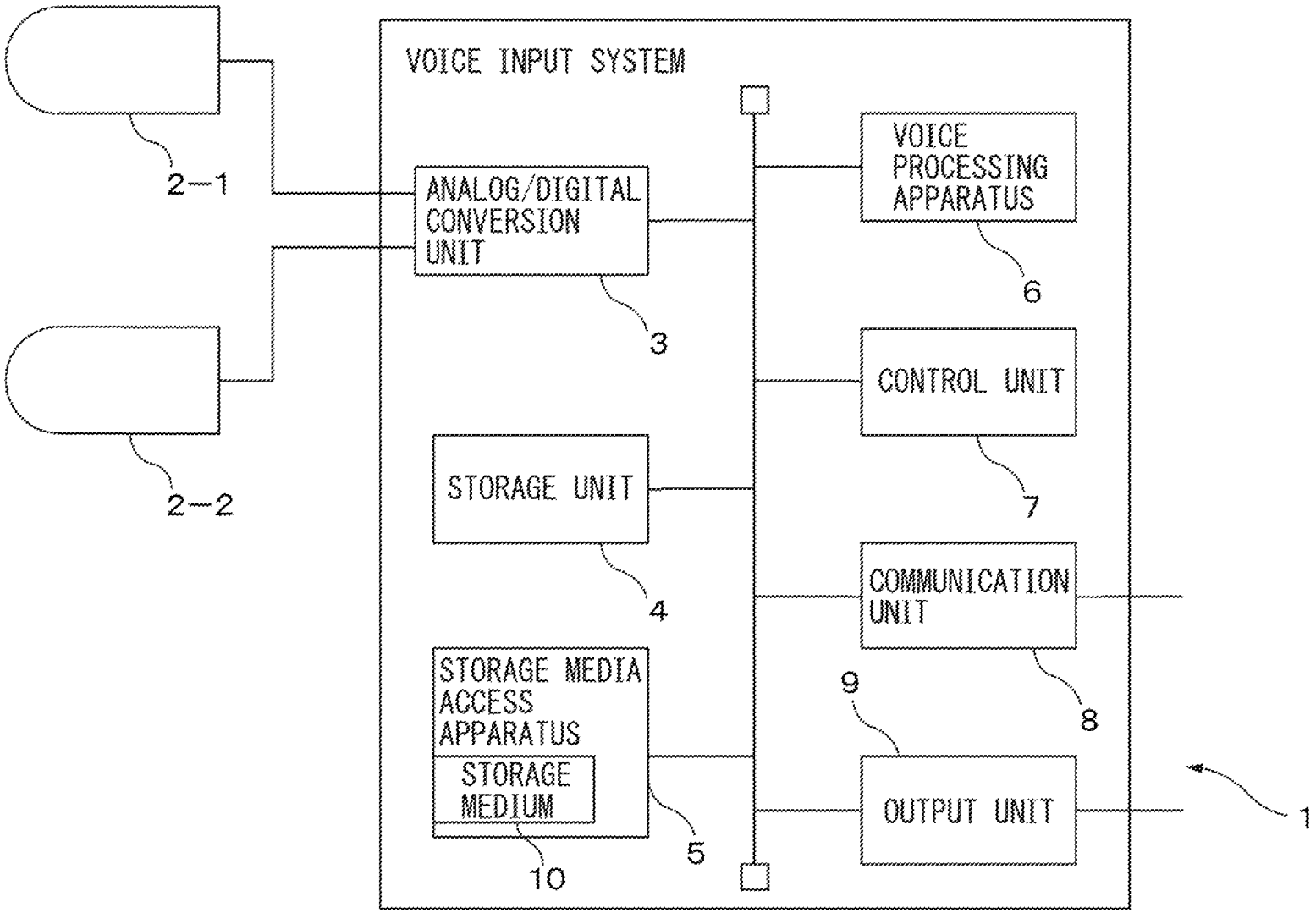
FIG. 1 is a diagram schematically illustrating the configuration of a voice input system equipped with a voice processing apparatus according to one embodiment.

FIG. 1 is a diagram schematically illustrating the configuration of a voice input system equipped with a voice processing apparatus according to one embodiment. The voice input system 1 is, for example, a teleconferencing system, and includes, in addition to the voice processing apparatus 6, voice input units 2-1 and 2-2, an analog/digital conversion unit 3, a storage unit 4, a storage media access apparatus 5, a control unit 7, a communication unit 8, and an output unit 9.

The voice input units 2-1 and 2-2, each equipped, for example, with a microphone, capture voice from the surroundings of the voice input units 2-1 and 2-2, and supply analog voice signals proportional to the sound level of the captured voice to the analog/digital conversion unit 3. The voice input units 2-1 and 2-2 are spaced a prescribed distance (for example, several centimeters to several tens of centimeters) away from each other so that the voice arrives at the respective voice input units at different times according to the location of the voice sound source. As a result, the phase difference between the voice signals captured by the respective voice input units 2-1 and 2-2 varies according to the direction of the sound source. The voice processing apparatus 6 can therefore estimate the direction of the sound source by examining this phase difference.

The analog/digital conversion unit 3 includes, for example, an amplifier and an analog/digital converter. The analog/digital conversion unit 3, using the amplifier, amplifies the analog voice signals received from the respective voice input units 2-1 and 2-2. Then, each amplified analog voice signal is sampled at predetermined intervals of time by the analog/digital converter in the analog/digital conversion unit 3, thus generating a digital voice signal. For convenience, the digital voice signal generated by converting the analog voice signal received from the voice input unit 2-1 will hereinafter be referred to as the first voice signal, and likewise, the digital voice signal generated by converting the analog voice signal received from the voice input unit 2-2 will hereinafter be referred to as the second voice signal. The analog/digital conversion unit 3 passes the first and second voice signals to the voice processing apparatus 6.

The storage unit 4 includes, for example, a read-write semiconductor memory and a read-only semiconductor memory. The storage unit 4 stores various kinds of computer programs and various kinds of data to be used by the voice input system 1. The storage unit 4 may further store the first and second voice signals corrected by the voice processing apparatus 6.

The storage media access apparatus 5 is an apparatus for accessing a storage medium 10 which is, for example, a magnetic disk, a semiconductor memory card, or an optical storage medium. For example, the storage media access apparatus 5 reads the storage medium 10 to load a computer program to be run on the control unit 7 and passes it to the control unit 7. Further, when the control unit 7 executes a program for implementing the functions of the voice processing apparatus 6, as will be described later, the storage media access apparatus 5 may load the voice processing computer program from the storage medium 10 and pass it to the control unit 7.

The voice processing apparatus 6 corrects the first and second voice signals by attenuating noise or sound contained in the first and second voice signals and originating from any other sound source than the sound source located in the specific direction, and thereby makes the voice coming from that direction easier to hear. The voice processing apparatus 6 outputs the thus corrected first and second voice signals.

The voice processing apparatus 6 and the control unit 7 may be combined into one unit. In this case, the voice processing performed by the voice processing apparatus 6 is carried out by a functional module implemented by a computer program executed on a processor contained in the control unit 7. The various kinds of data generated by the voice processing apparatus or to be used by the voice processing apparatus are stored in the storage unit 4. The details of the voice processing apparatus 6 will be described later.

The control unit 7 includes one or a plurality of processors, a memory circuit, and their peripheral circuitry. The control unit 7 controls the entire operation of the voice input system 1.

When, for example, a teleconference is started by a user operating an operation unit such as a keyboard (not depicted) included in the voice input system 1, the control unit 7 performs call control processing, such as call initiation, call answering, and call clearing, between the voice input system 1 and switching equipment or a Session Initiation Protocol (SIP) server. Then, the control unit 7 encodes the first and second voice signals corrected by the voice processing apparatus 6, and outputs the encoded first and second voice signals via the communication unit 8. The control unit 7 can use voice encoding techniques defined, for example, in ITU-T (International Telecommunication Union Telecommunication Standardization Sector) recommendations G.711, G.722.1, or G.729A. Further, the control unit 7 may decode encoded signals received from other apparatus via the communication unit 8 and may output the decoded voice signals to a speaker (not depicted) via the output unit 9.

The communication unit 8 transmits the first and second voice signals corrected by the voice processing apparatus 6 to other apparatus connected to the voice input system 1 via a communication network. For this purpose, the communication unit 8 includes an interface circuit for connecting the voice input system 1 to the communication network. The communication unit 8 converts the voice signals encoded by the control unit 7 into transmit signals conforming to a particular communication standard. Then, the communication unit 8 outputs the transmit signals onto the communication network. Further, the communication unit 8 may receive signals conforming to the particular communication standard from the communication network and may recover encoded voice signals from the received signals. Then, the communication unit 8 may pass the encoded voice signals to the control unit 7. The particular communication standard may be, for example, the Internet Protocol (IP), and the transmit signals and the received signals may be signals packetized in accordance with IP.

The output unit 9 receives the voice signals from the control unit 7 and outputs them to the speaker (not depicted). The output unit 9 includes, for example, a digital/analog converter for converting the voice signals received from the control unit 7 into analog signals.

The details of the voice processing apparatus 6 will be described below.

Figure 2:
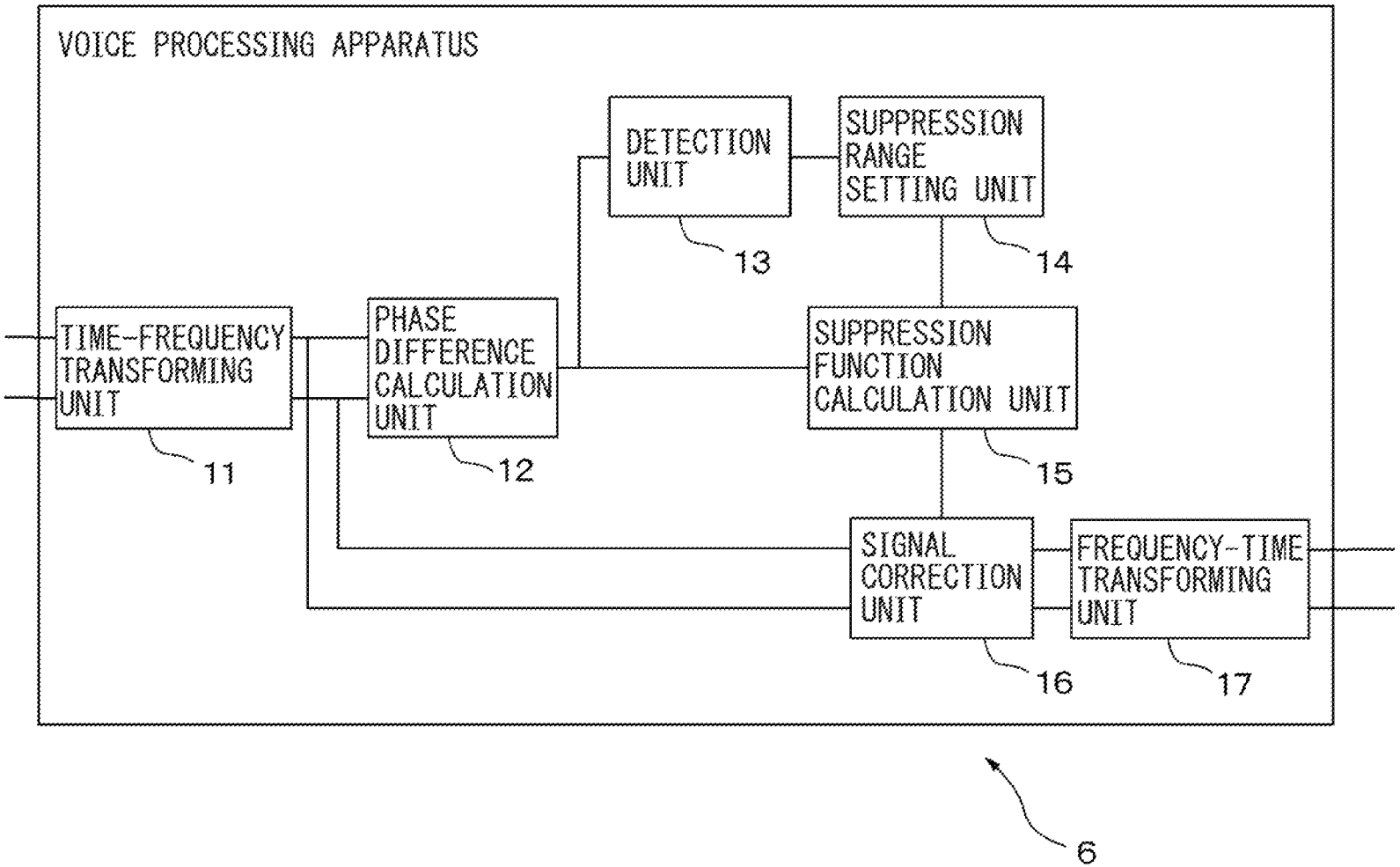
FIG. 2 is a diagram schematically illustrating the configuration of a voice processing apparatus according to a first embodiment.

FIG. 2 is a diagram schematically illustrating the configuration of the voice processing apparatus 6. The voice processing apparatus 6 includes a time-frequency transforming unit 11, a phase difference calculation unit 12, a detection unit 13, a suppression range setting unit 14, a suppression function calculation unit 15, a signal correction unit 16, and a frequency-time transforming unit 17. These units constituting the voice processing apparatus 6 may be implemented as separate circuits on the voice processing apparatus 6 or may be implemented in the form of a single integrated circuit that implements the functions of the respective units. Alternatively, these units constituting the voice processing apparatus 6 may each be implemented as a functional module by a computer program executed on the processor incorporated in the control unit 7.

The time-frequency transforming unit 11 transforms the first and second voice signals into first and second frequency signals in the frequency domain on a frame-by-frame basis, with each frame having a predefined time length (for example, several tens of milliseconds). More specifically, the time-frequency transforming unit 11 applies a time-frequency transform, such as a fast Fourier transform (FFT) or a modified discrete cosine transform (MDCT), to the first and second voice signals to transform the respective signals into the first and second frequency signals. Alternatively, the time-frequency transforming unit 11 may use other time-frequency transform techniques such as a quadrature mirror filter (QMF) bank or a wavelet transform. The time-frequency transforming unit 11 supplies the first and second frequency signals to the phase difference calculation unit 12 and the signal correction unit 16 on a frame-by-frame basis.

Each time the first and second frequency signals are received, the phase difference calculation unit 12 calculates the phase difference between the first and second frequency signals for each of a plurality of frequency bands. The phase difference calculation unit 12 calculates the phase difference $\Delta\theta_f$ for each frequency band, for example, in accordance with the following equation.

$$\Delta\theta_f = \tan^{-1}\left(\frac{S_{1f}}{S_{2f}}\right) \quad (1)$$

$$0 < f < fs/2$$

where $S_{1f}$ represents the component of the first frequency signal in a given frequency band f, and $S_{2f}$ represents the component of the second frequency signal in the same frequency band f. On the other hand, fs represents the sampling frequency. The phase difference calculation unit 12 passes the phase difference $\Delta\theta_f$ calculated for each frequency band to the detection unit 13 and the signal correction unit 16.

The detection unit 13 determines on a frame-by-frame basis for each of the plurality of frequency bands whether or not the phase difference $\Delta\theta_f$ falls within the range that the phase difference corresponding to the direction of the target sound source can take. Then, the detection unit 13 obtains the percentage of the phase difference $\Delta\theta_f$ falling within that range over the immediately preceding predetermined number of frames, and detects as a relaxed frequency band any frequency band for which the percentage does not satisfy a condition corresponding to a sound coming from the direction of the target sound source. The relaxed frequency band refers to the frequency band for which the range over which the first and second frequency signals are not to be attenuated is set wider than the range that the phase difference corresponding to the direction of the target sound source can take.

Figure 3:
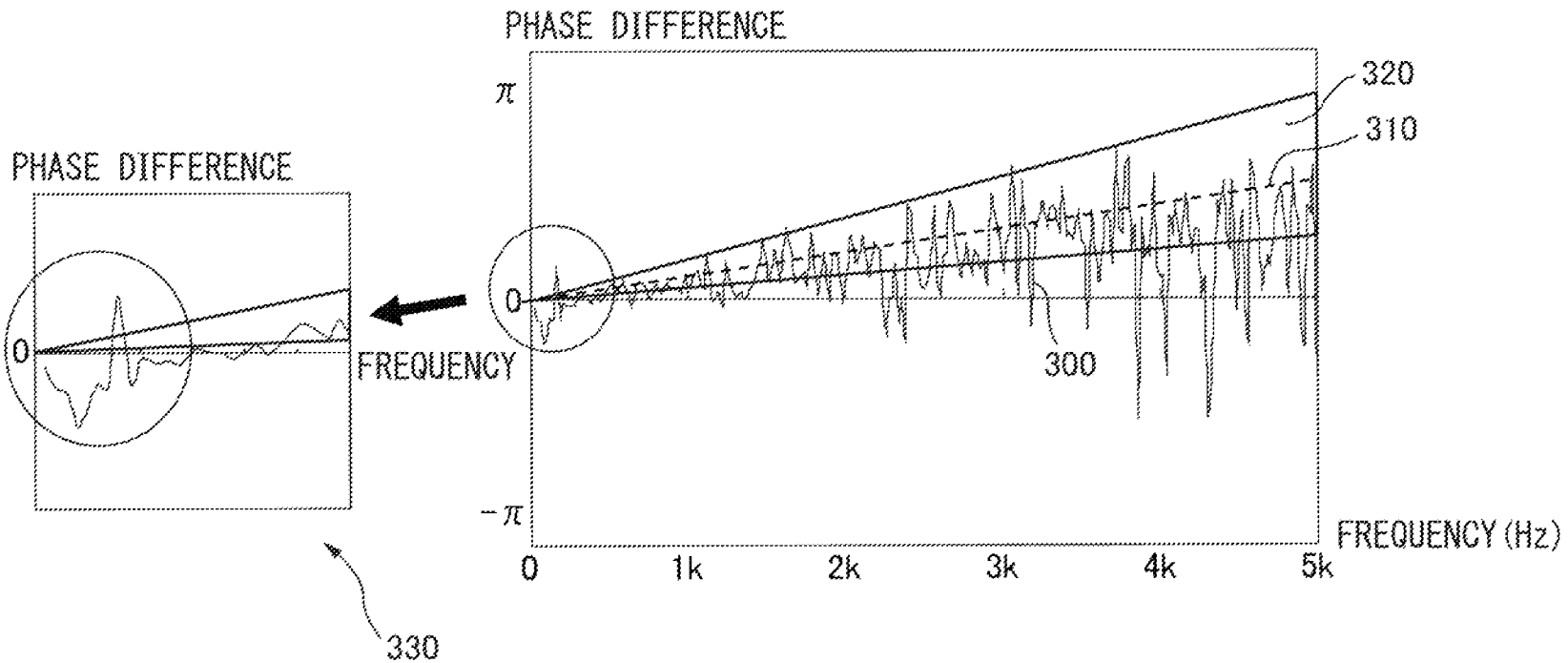
FIG. 3 is a diagram illustrating one example of the phase difference between first and second frequency signals for a sound coming from a sound source located in a specific direction.

FIG. 3 is a diagram illustrating one example of the phase difference between the first and second frequency signals for the sound coming from the sound source located in the specific direction. In FIG. 3, the abscissa represents the frequency, and the ordinate represents the phase difference. Graph 300 represents the phase difference measured on a frequency-band by frequency-band basis in a given frame. Dashed line 310 represents the theoretical value of the phase difference for the specific sound source direction, and range 320 indicates the range of values that the phase difference can take when the sound source direction is assumed to lie within a given direction range centered about the specific sound source direction. Further, 330 indicates an enlarged view of the portion of the graph 300 lower than about 500 Hz. As depicted in FIG. 3, it can be seen that, for frequencies lower than about 300 Hz, the phase difference is mostly outside the range 320. This is due to the difference in characteristics between the individual microphones contained in the voice input units 2-1 and 2-2 or due to sound reflections, reverberations, etc. in the environment where the microphones are installed. In such frequency bands, the phase difference can deviate outside the range 320 over a plurality of frames.

Then, for each frequency band, the detection unit 13 determines whether or not the phase difference $\Delta\theta_f$ falls within the range that the phase difference can take for each given one of a plurality of sub-direction ranges into which the direction range in which the sound source may be located has been divided. For convenience, the range that the phase difference can take for a given sub-direction range will hereinafter be referred to as the phase difference range predefined for that sub-direction range.

Figure 4:
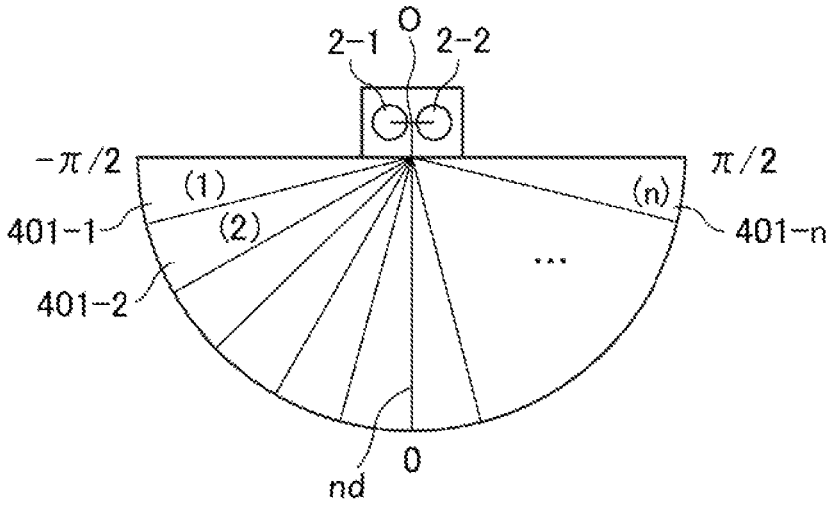
FIG. 4 is a diagram illustrating one example of the relationship between two microphones and a plurality of sub-direction ranges.

FIG. 4 is a diagram illustrating one example of the relationship between the voice input units 2-1 and 2-2 and the plurality of sub-direction ranges. As illustrated in FIG. 4, when the angle of the normal "nd" drawn to the line joining the two voice input units 2-1 and 2-2 at its midpoint "O" is assumed to be 0, the counterclockwise direction from the normal "nd" is taken as positive, and the clockwise direction is taken as negative. It is also assumed that the direction range in which the sound source may be located is from $-\pi/2$ to $\pi/2$. Then, the direction range in which the sound source may be located is divided into n equal ranges, for example, with the midpoint "O" as the origin, to form the sub-direction ranges 401-1 to **401-*n*. Here, n is an integer not smaller than 2. For example, when n=3, the sub-direction ranges 401-1 to 401-3** are from $-\pi/2$ to $-\pi/6$, from $-\pi/6$ to $\pi/6$, and from $\pi/6$ to $\pi/2$, respectively.

The detection unit 13 sequentially sets each sub-direction range as an attention sub-direction range. Then, for each frequency band, the detection unit 13 determines on a frame-by-frame basis whether the phase difference falls within the phase difference range predefined for that attention sub-direction range. As the voice input units 2-1 and 2-2 are spaced a greater distance away from each other, the difference between the time at which the sound from a particular sound source reaches the voice input unit 2-1 and the time at which the sound reaches the voice input unit 2-2 becomes larger, and as a result, the phase difference also becomes larger. Accordingly, the phase difference at the center of the phase difference range is set in accordance with the distance between the voice input units 2-1 and 2-2. Further, the wider the sub-direction range, the wider the phase difference range for the sub-direction range. Furthermore, since the wavelength of the sound becomes shorter as the frequency of the sound becomes higher, the phase difference between the first and second frequency signals increases as the frequency increases. As a result, the phase difference range becomes wider as the frequency increases.

Figure 5:
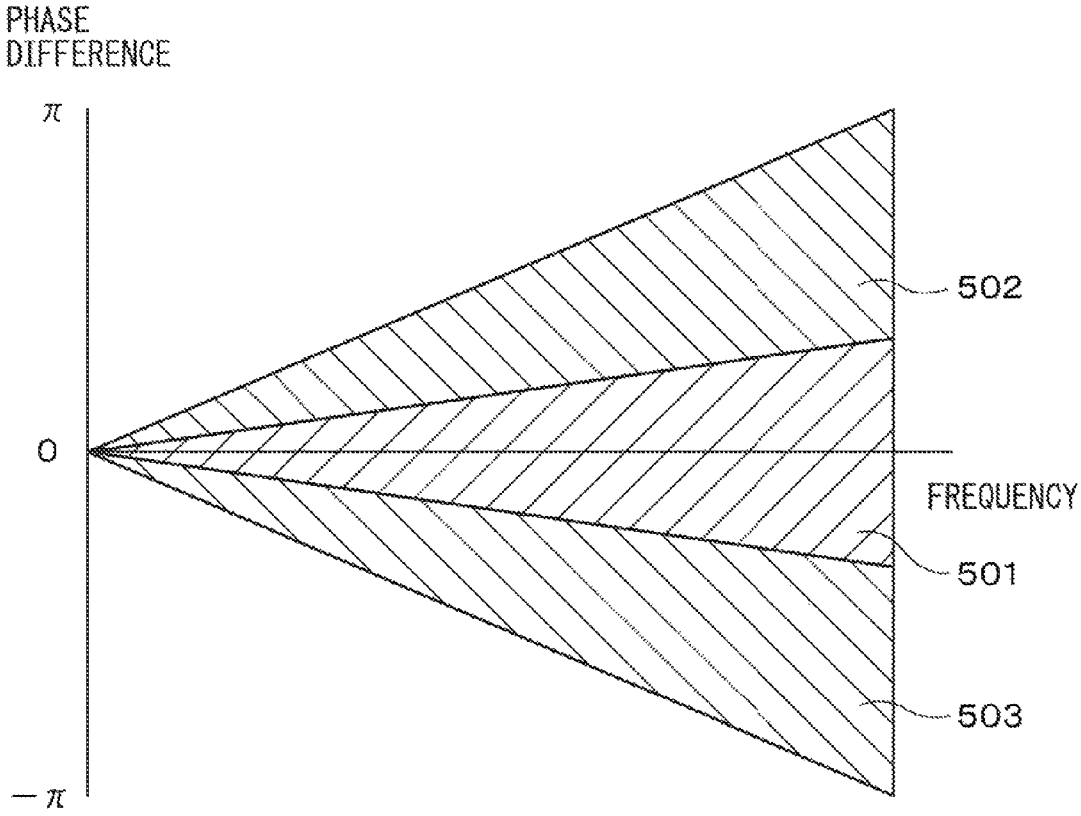
FIG. 5 is a diagram illustrating one example of a phase difference range that can be taken for each sub-direction range.

FIG. 5 is a diagram illustrating one example of how the phase difference ranges are set for the respective sub-direction ranges. In the illustrated example, three sub-direction ranges are set. The phase difference range 501 corresponds to the sub-direction range containing the normal "nd" drawn to the line joining the two voice input units 2-1 and 2-2. The phase difference range 502 corresponds to the sub-direction range located away from the normal "nd" toward the voice input unit 2-1; on the other hand, the phase difference range 503 corresponds to the sub-direction range located away from the normal "nd" toward the voice input unit 2-2.

The detection unit 13 obtains a decision value d(t) for the most recent frame "t" that indicates whether the phase difference falls within the phase difference range predefined for the attention sub-direction range. More specifically, when the phase difference falls within the phase difference range predefined for the attention sub-direction range, the detection unit 13 sets the decision value d(t) to 1 for the attention sub-direction range for that frame "t". On the other hand, when the phase difference falls outside the phase difference range, the detection unit 13 sets the decision value d(t) to 0. Then, for each frequency band, the detection unit 13 calculates from the following equation the percentage of the phase difference for the attention sub-direction range falling within the phase difference range over the immediately preceding predetermined number of frames. For convenience, this percentage will hereinafter be referred to as the achieved rate.

$$ARP_f^n(t)=\alpha\times ARP_f^n(t-1)+(1-\alpha)\times d(t) \quad (2)$$

where $ARP_f^n(t-1)$ and $ARP_f^n(t)$ indicate the achieved rates for the frequency band f for the n-th sub-direction range in the frames (t−1) and (t), respectively. Further, $\alpha$ is a forgetting coefficient which is set equal to 1 minus the reciprocal of the number of frames over which to calculate the achieved rate, for example, to a value within the range of 0.9 to 0.99. As is apparent from the equation (2), the range of values that the achieved rate $ARP_f^n(t)$ can take is from 0 to 1. Immediately after the voice processing apparatus 6 is started up, the value of the achieved rate calculated from the equation (2) is not stable. Therefore, for the first frame (t=1) after the voice processing apparatus 6 is started up, the detection unit 13 sets the forgetting coefficient $\alpha$ in the equation (2) to 0. Then, when t is 10 or less, the detection unit 13 sets the forgetting coefficient $\alpha$ to 0.5. When t exceeds 10, the forgetting coefficient $\alpha$ may be set to a value within the range of 0.9 to 0.99.

The detection unit 13 includes, for example, a volatile memory circuit, and stores the achieved rate $ARP_f^n(t)$ for a predetermined number of preceding frames in the memory circuit. The number of frames here may be set equal to the number of frames over which to calculate the achieved rate.

Figure 6:
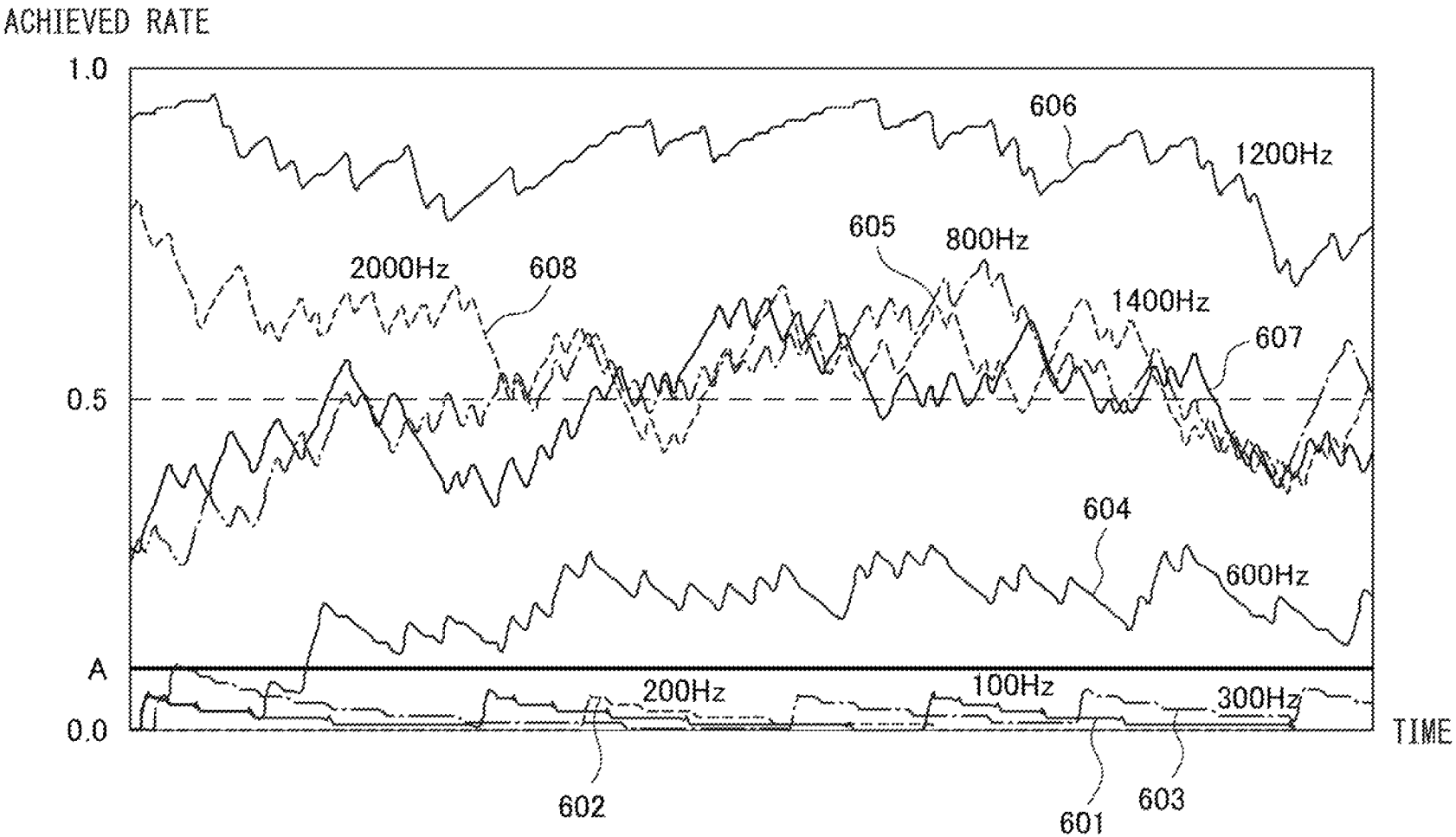
FIG. 6 is a diagram illustrating by way of example how an achieved rate varies over time.

FIG. 6 is a diagram illustrating by way of example how the achieved rate varies over time. In FIG. 6, the abscissa represents the time, and the ordinate represents the achieved rate. Further, graphs 601 to 608 depict how the achieved rate varies with time for frequencies 100 Hz, 200 Hz, 300 Hz, 600 Hz, 800 Hz, 1200 Hz, 1400 Hz, and 2000 Hz, respectively. As depicted in FIG. 6, in the frequency range not higher than 300 Hz, the measured value of the phase difference differs from its theoretical value due to the difference in characteristics between the individual microphones or due to the environment where the microphones are installed. As a result, in the frequency range not higher than 300 Hz, the achieved rate is very low and stays below a constant value A throughout the entire period of time. On the other hand, in the frequency range higher than 300 Hz, it is seen that the achieved rate is higher than the constant value A throughout most of the time.

In view of the above, after waiting until the time needed for the value of the achieved rate to stabilize (for example, 1 to 2 milliseconds) has elapsed from the startup of the voice processing apparatus 6, the detection unit 13 obtains on a frame-by-frame basis a maximum value $MAXARP_f^n$ among the achieved rates $ARP_f^n(t)$ stored in the memory circuit for each sub-direction range and for each frequency band. For example, among a number, M, of achieved rates $ARP_{fj}^{ni}(t)$ to $ARP_{fj}^{ni}(t-(M+1))$ calculated for the sub-direction range ni and the frequency band fj and stored in the memory circuit, if the achieved rate $ARP_{fj}^{ni}(m)$ at time m is the highest achieved rate, then $ARP_{fj}^{ni}(m)$ is obtained as $MAXARP_{fj}^{ni}$.

Further, for each frequency band, the detection unit 13 calculates the average value $AVMAXARP_f$ and the variance $VMAXARP_f$ of $MAXARP_f^n$ for all the sub-direction ranges. Generally, when the target sound source is located in a specific direction, $MAXARP_f^n$ for the sub-direction range containing that specific direction becomes higher. As a result, the average value $AVMAXARP_f$ also becomes higher. Further, since the value of $MAXARP_f^n$ varies among the sub-direction ranges, the variance $VMAXARP_f$ becomes relatively large. However, in frequency bands in which the phase difference between the first and second frequency signals varies due to such factors as the difference in characteristics between the individual microphones or the environment where the microphones are installed, since $MAXARP_f^n$ is low for all the sub-direction ranges, the average value $AVMAXARP_f$ is also low. Further, in such frequency bands, since the variation in $MAXARP_f^n$ among the sub-direction ranges decreases, the variance $VMAXARP_f$ becomes relatively small.

In view of the above, for each frequency band, the detection unit 13 compares the average value $AVMAXARP_f$ with a predetermined threshold value Th1 and the variance $VMAXARP_f$ with a variance threshold value Th2. Then, for any frequency band for which the average value $AVMAXARP_f$ is not larger than the threshold value Th1 and the variance $VMAXARP_f$ is also not larger than the variance threshold value Th2, the detection unit 13 determines that the non-suppression range in which the first and second frequency signals are not to be attenuated needs to be made wider than a reference range. The reference range corresponds to the range that the phase difference corresponding to the direction of the target sound source can take. Accordingly, when searching for the direction of the sound source for each sub-direction range, the phase difference range for the sub-direction range coincides with the reference range. On the other hand, for any frequency band for which the average value $AVMAXARP_f$ is larger than the threshold value Th1 or the variance $VMAXARP_f$ is larger than the variance threshold value Th2, the detection unit 13 determines that the non-suppression range is set equal to the reference range. Then, the detection unit 13 notifies the suppression range setting unit 14 of the relaxed frequency band which is the frequency band for which it is determined that the non-suppression range needs to be made wider than the reference range.

The threshold value Th1 is set, for example, based on the distribution of the maximum values of the achieved rates obtained for all the frequency bands. For example, the threshold value Th1 is set equal to 1 minus the maximum value among the achieved rates calculated for all the frequency bands or to the resulting value multiplied by a coefficient not smaller than 0.8 but smaller than 1.0.

On the other hand, the variance threshold value Th2 is set, for example, equal to the variance value corresponding to the minimum value of the frequency in a set of values not larger than the mode or median of the variance in a histogram of the distribution of the maximum value $MAXARP_f$ of the achieved rate obtained on a frame-by-frame basis for each frequency band.

FIG. 7 a diagram illustrating a table 700 depicting by way of example the maximum value $MAXARP_f^n$, average value $AVMAXARP_f$, and variance $VMAXARP_f$ of the achieved rate obtained on a frequency-band by frequency-band basis. In FIG. 7, the top row 701 of the table 700 indicates the frequency bands. In the illustrated example, the frequency range corresponding to the human hearing range is divided into 128 frequency bands. Further, in the illustrated example, six sub-direction ranges are set, and indexes "1" to "6" indicating the respective sub-direction ranges are carried in the leftmost column 702 of the table 700. The average value $AVMAXARP_f$ and variance $VMAXARP_f$ of $MAXARP_f^n$ obtained on a frequency-band by frequency-band basis are carried in the two bottom rows of the table 700.

Referring to FIG. 7, for the frequency bands "1" and "2", for example, the average value $AVMAXARP_f$ is smaller than the threshold value Th1, and the variance $VMAXARP_f$ is also smaller than the variance threshold value Th2. As a result, it is determined that, for the frequency bands "1" and "2", the non-suppression range needs to be made wider than the reference range.

Figure 8:
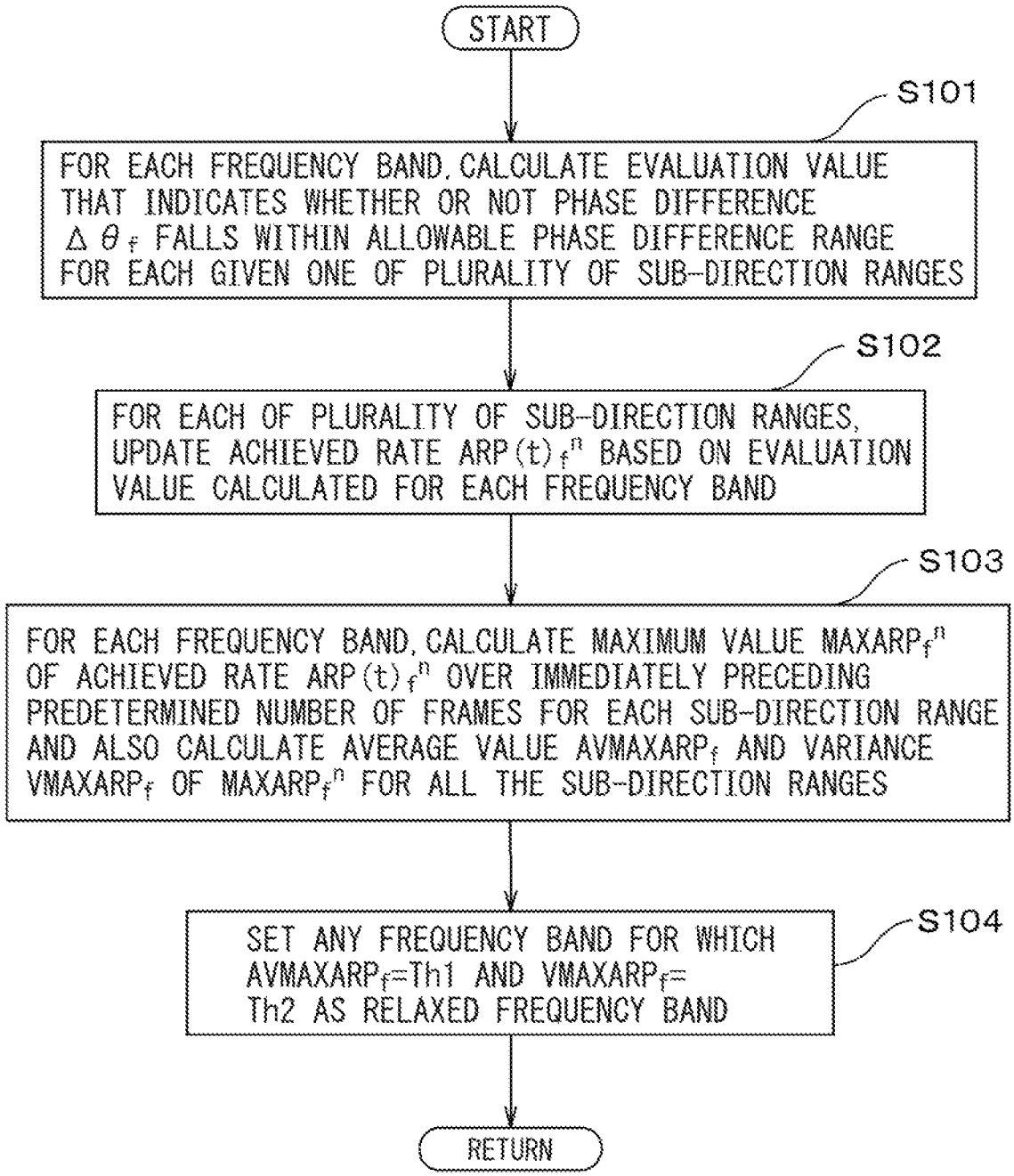
FIG. 8 is an operational flowchart of a relaxed frequency band setting process.

FIG. 8 is an operational flowchart of a relaxed frequency band setting process which is carried out by the detection unit 13.

The detection unit 13 calculates for each frequency band an evaluation value that indicates whether or not the phase difference $\Delta\theta_f$ falls within the phase difference range for each given one of the plurality of sub-direction ranges (step S101). Then, for each of the plurality of sub-direction ranges, the detection unit 13 updates the achieved rate $ARP(t)_f^n$ based on the evaluation value calculated for each frequency band (step S102).

The detection unit 13 calculates for each frequency band the maximum value $MAXARP_f^n$ of the achieved rate $ARP(t)_f^n$ over the immediately preceding predetermined number of frames for each sub-direction range (step S103). Further, the detection unit 13 calculates for each frequency band the average value $AVMAXARP_f$ and variance $VMAXARP_f$ of $MAXARP_f^n$ for all the sub-direction ranges. Then, the detection unit 13 sets as a relaxed frequency band any frequency band for which the average value $AVMAXARP_f$ is not larger than the threshold value Th1 and the variance $VMAXARP_f$ is also not larger than the variance threshold value Th2 (step S104). After step S104, the detection unit 13 terminates the relaxed frequency band setting process.

Further, the detection unit 13 identifies the sub-direction range that yields the largest $MAXARP_f^n$ value in each given frequency band, in order to estimate a target direction range which contains the direction in which the target sound source is located. Then, the detection unit 13 estimates that the sub-direction range in which the number of largest $MAXARP_f^n$ values is the largest of all the sub-direction ranges is the target direction range. The detection unit 13 may estimate the target direction range by using any one of other techniques used to estimate the direction of a sound source. For example, the detection unit 13 may estimate the target direction range based on a cost function such as disclosed in Japanese Laid-open Patent Publication No. 2010-176105. The detection unit 13 notifies the suppression range setting unit 14 of the thus estimated target direction range.

The suppression range setting unit 14 is an example of a range setting unit and sets, for each frequency band, a suppression range, i.e., the phase difference range in which the first and second frequency signals are to be attenuated, and a non-suppression range, i.e., the phase difference range in which the first and second frequency signals are not to be attenuated. In this case, for any relaxed frequency band indicated by the detection unit 13, the suppression range setting unit 14 sets the non-suppression range wider than the reference range predefined for the target direction range. The suppression range and the non-suppression range are mutually exclusive, so that the phase difference range contained in the suppression range does not overlap the phase difference range contained in the non-suppression range. An intermediate region across which the amount of suppression is gradually changed may be provided between the suppression range and the non-suppression range in order to avoid an abrupt change in the amount of suppression between the two ranges. A method of setting the non-suppression range will be described below.

The suppression range setting unit 14 includes, for example, a nonvolatile memory circuit. The memory circuit stores, for example, for each frequency band, a phase difference width $\delta_f$ which defines the range of variation of the phase difference corresponding to one sub-direction range, and the center value $C_f^n$ of the phase difference for each of the sub-direction ranges n (n=1, 2, 3, . . . , N).

The suppression range setting unit 14 refers to the memory circuit to identify the center value $C_f^n$ of the phase difference for each frequency band corresponding to the target direction range indicated by the detection unit 13, and sets the range with width $\delta_f$ centered about the center value $C_f^n$ as the reference range.

Next, for any relaxed frequency band indicated by the detection unit 13, the suppression range setting unit 14 sets the non-suppression range wider than the reference range.

Figure 9A:
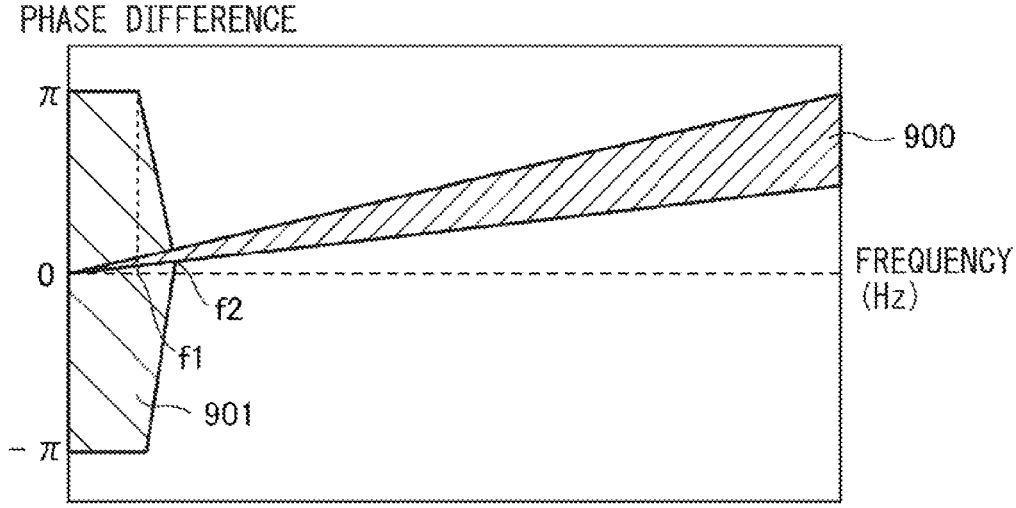
FIGS. 9A to 9C are diagrams illustrating by way of example the relationship between a reference range and a non-suppression range modified for a relaxed frequency band.
Figure 9B:
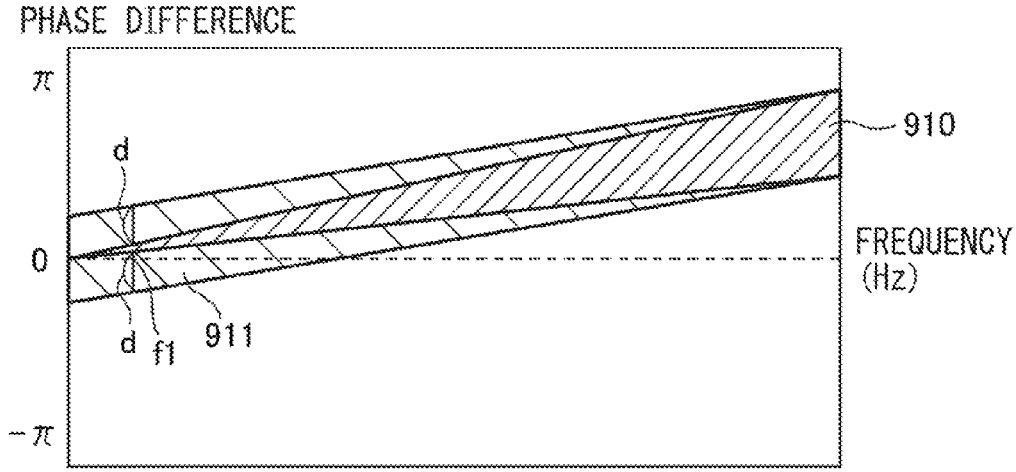
Figure 9C:
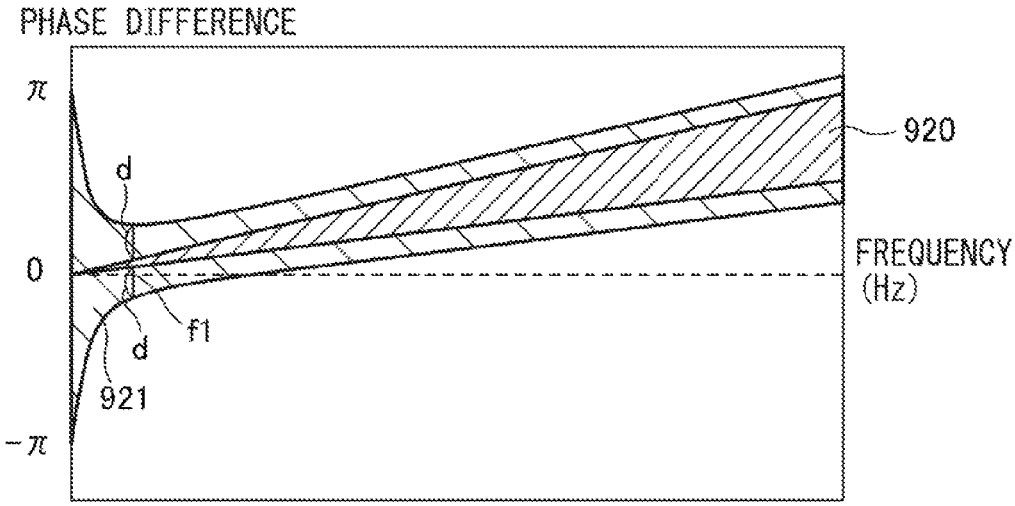

FIGS. 9A to 9C are diagrams illustrating by way of example the relationship between the reference range and the non-suppression range modified for the relaxed frequency band. In FIGS. 9A to 9C, the abscissa represents the frequency, and the ordinate represents the phase difference. In the example of FIG. 9A, the range of frequencies not higher than f1 is indicated as the relaxed frequency band. In this example, the entire phase difference range of $-\pi$ to $\pi$ is set as the non-suppression range 901 for any frequency band not higher than f1. In the range of frequencies higher than f1, the non-suppression range 901 is set so that its width decreases linearly and, at frequency f2 which is higher than f1 by a predetermined offset value, the width of the non-suppression range 901 becomes the same as the width of the reference range 900. The predetermined offset value is, for example, in the range of 50 Hz to 100 Hz, or is set equal to the frequency f1 multiplied by a value of 0.1 to 0.2.

In the example of FIG. 9B also, the range of frequencies not higher than f1 is indicated as the relaxed frequency band. In this case, at frequency f1, the non-suppression range 911 is expanded upward and downward by a predetermined phase difference width "d" relative to the upper and lower limits of the phase difference defined by the reference range 910. Further, the width by which to expand the non-suppression range is set so as to decrease linearly and monotonically as the frequency increases from the minimum frequency to the maximum frequency of the first and second frequency signals.

In the example of FIG. 9C also, the range of frequencies not higher than f1 is indicated as the relaxed frequency band. In this case, at frequency f1, the non-suppression range 921 is expanded upward and downward by a predetermined phase difference width "d" relative to the upper and lower limits of the phase difference defined by the reference range 920. Further, the width by which to expand the non-suppression range is set so as to decrease monotonically and proportionally to the reciprocal of the frequency as the frequency increases from the minimum frequency to the maximum frequency of the first and second frequency signals; for example, the width "d" by which to expand the non-suppression range is set equal to (a/f+b) where a and b are positive constants).

The width "d" by which to expand the non-suppression range may be determined based on the absolute value of the amount by which the actually measured phase difference deviates from the target direction range. In this case, when the phase difference detected for a particular sub-direction range is larger than the phase difference range for that particular sub-direction range, the detection unit 13 obtains the difference $DDU_f^n(=DPP_f-UPT_f^n)$ between the phase difference $DPP_f$ and the upper limit value $UPT_f^n$ of the phase difference range. Then, the detection unit 13 obtains the maximum value $MaxDDU_f^n$ of $DDU_f^n$ for each sub-direction range. Similarly, when the phase difference detected for a particular sub-direction range is smaller than the phase difference range for that particular sub-direction range, the detection unit 13 obtains the difference $DDL_f^n(=DPP_f-LWT_f^n)$ between the phase difference $DPP_f$ and the lower limit value $LWT_f^n$ of the phase difference range. Then, the detection unit 13 obtains the minimum value $MinDDL_f^n$ of $DDL_f^n$ for each sub-direction range. The detection unit 13 notifies the suppression range setting unit 14 of the $MinDDL_f^n$ and $MaxDDU_f^n$ of the relaxed frequency band for the target direction range.

The suppression range setting unit 14 chooses the absolute value $|MinDDL_f^n|$ or $|MaxDDU_f^n|$ of the $MinDDL_f^n$ or $MaxDDU_f^n$ of the relaxed frequency band, whichever is larger, as the width "d" by which to expand the non-suppression range.

When $|MinDDL_f^n|$ for the relaxed frequency band is 0, the suppression range setting unit 14 may expand only the upper limit of the phase difference in the non-suppression range by one of the above methods. When $|MaxDDU_f^n|$ for the relaxed frequency band is 0, the suppression range setting unit 14 may also expand only the lower limit of the phase difference in the non-suppression range by one of the above methods.

Further, the suppression range setting unit 14 may determine the width "d" by which to expand the non-suppression range as a function of the frequency. In this case, pairs of coefficients that define a plurality of functions defining the width "d" are stored in advance in the memory circuit provided in the suppression range setting unit 14. The suppression range setting unit 14 selects the pair of function coefficients with which $|MinDDL_f^n|$ and $|MaxDDU_f^n|$ for one or more relaxed frequency bands indicated to it are smaller than the width "d". Then, the suppression range setting unit 14 may set the non-suppression range by expanding the reference range in accordance with the selected function.

For example, suppose that the function d=g(f) of the frequency "f" and the width "d" is expressed by g(f)=a×f+b, where a and b are constants. Then, suppose that three (a, b) pairs, (i) (−0.008, 1.0), (ii) (−0.015, 2.0), and (iii) (−0.02, 2.5), are stored in the memory circuit provided in the suppression range setting unit 14. In this case, suppose that the relaxed frequency bands f are 2, 3, 4, 5, and 6 and the values of $MinDDL_f^n$ and $MaxDDU_f^n$ for the respective relaxed frequency bands are as follows.

f=2 $MinDDL_2^n=-1.2$, $MaxDDU_2^n=1.0$
f=3 $MinDDL_3^n=-0.2$, $MaxDDU_3^n=0.3$
f=4 $MinDDL_4^n=-0.9$, $MaxDDU_4^n=1.1$
f=5 $MinDDL_5^n=-1.2$, $MaxDDU_5^n=1.8$
f=6 $MinDDL_6^n=-1.1$, $MaxDDU_6^n=1.5$

In this case, with the constant pairs (ii) and (iii), the absolute values of $MinDDL_5''$ and $MaxDDU_f''$ for all the relaxed frequency bands are smaller than the width "d" by which to expand the non-suppression range. Then, between the constant pairs (ii) and (iii), the suppression range setting unit 14 selects the constant pair (ii) with which the width "d" is smaller for all the relaxed frequency bands, and determines the width "d" by which to expand the non-suppression range for each frequency band in accordance with the selected constant pair.

In any of the above examples, the range of frequencies not higher than the predetermined frequency has been set as the relaxed frequency band, because the longer the sound wavelength is, the more susceptible it is to reflections, etc., and the more likely that the actually measured phase difference does not agree with the phase difference corresponding to the direction of the sound source. However, the suppression range setting unit 14 may set the non-suppression range for the relaxed frequency band wider than the reference range in accordance with other rules than those employed in the above examples. For example, for each relaxed frequency band indicated, the suppression range setting unit 14 may simply set the non-suppression range wider than the reference range by the predetermined phase difference width "d". Further, the phase difference width "d" may be set equal to $|MaxDDU_f''|$ or $|MinDDL_f''|$ whichever is larger.

The suppression range setting unit 14 notifies the suppression function calculation unit 15 of the set non-suppression range.

The suppression function calculation unit 15 calculates a suppression function for suppressing any voice signal arriving from a direction other than the direction in which the target sound source is located. For this purpose, the suppression function is set, for example, for each frequency band, as a gain value $G(f, \Delta\theta_f)$ that indicates the degree to which the signals are to be attenuated in accordance with the phase difference $\Delta\theta_f$ between the first and second frequency signals. The suppression function calculation unit 15 sets the gain value $G(f, \Delta\theta_f)$ for the frequency band f, for example, as follows.

$$G(f,\Delta\theta_f)=0 \text{ } (\Delta\theta_f \text{ is within the non-suppression range})$$

$$G(f,\Delta\theta_f)=10 \text{ } (\Delta\theta_f \text{ is outside the non-suppression range})$$

Alternatively, the suppression function calculation unit 15 may calculate the suppression function by other methods. For example, in accordance with the method disclosed in Japanese Laid-open Patent Publication No. 2007-318528, the suppression function calculation unit 15 calculates for each frequency band the probability that the target sound source is located in a specific direction and, based on the probability, calculates the suppression function. In this case also, the suppression function calculation unit 15 calculates the suppression function so that the gain value $G(f, \Delta\theta_f)$ when the phase difference $\Delta\theta_f$ is within the non-suppression range becomes smaller than the gain value $G(f, \Delta\theta_f)$ when the phase difference $\Delta\theta_f$ is outside the non-suppression range.

Further, the suppression function calculation unit 15 may set the gain value $G(f, \Delta\theta_f)$ when the phase difference $\Delta\theta_f$ is outside the non-suppression range so that the gain value increases monotonically as the absolute difference between the phase difference and the upper limit or lower limit of the non-suppression range increases.

The suppression function calculation unit 15 passes the gain value $G(f, \Delta\theta_f)$ calculated for each frequency band to the signal correction unit 16.

The signal correction unit 16 corrects the first and second frequency signals, for example, in accordance with the following equation, based on the phase difference $\Delta\theta_f$ between the first and second frequency signals, received from the phase difference calculation unit 12, and on the gain value $G(f, \Delta\theta_f)$ received from the suppression function calculation unit 15.

$$Y(f)=10^{-G(f,\Delta\theta_f)/20}\cdot X(f) \tag{3}$$

where X(f) represents the first or second frequency signal, and Y(f) represents the first or second frequency signal after correction. Further, f represents the frequency band. As can be seen from the equation (3), Y(f) decreases as the gain value $G(f, \Delta\theta_f)$ increases. This means that when the phase difference $\Delta\theta_f$ is outside the non-suppression range, the first and second frequency signals are attenuated by the signal correction unit 16. The correction function is not limited to the above equation (3), but the signal correction unit 16 may correct the first and second frequency signals by using some other suitable function for suppressing the first and second frequency signals whose phase difference is outside the non-suppression range. The signal correction unit 16 passes the corrected first and second frequency signals to the frequency-time transforming unit 17.

The frequency-time transforming unit 17 transforms the corrected first and second frequency signals into the signals in the time domain by reversing the time-frequency transformation performed by the time-frequency transforming unit 11, and thereby produces the corrected first and second voice signals. With the corrected first and second voice signals, the sound coming from the target sound source is easier to hear by attenuating any sound arriving from a direction other than the direction in which the target sound source is located.

Figure 10:
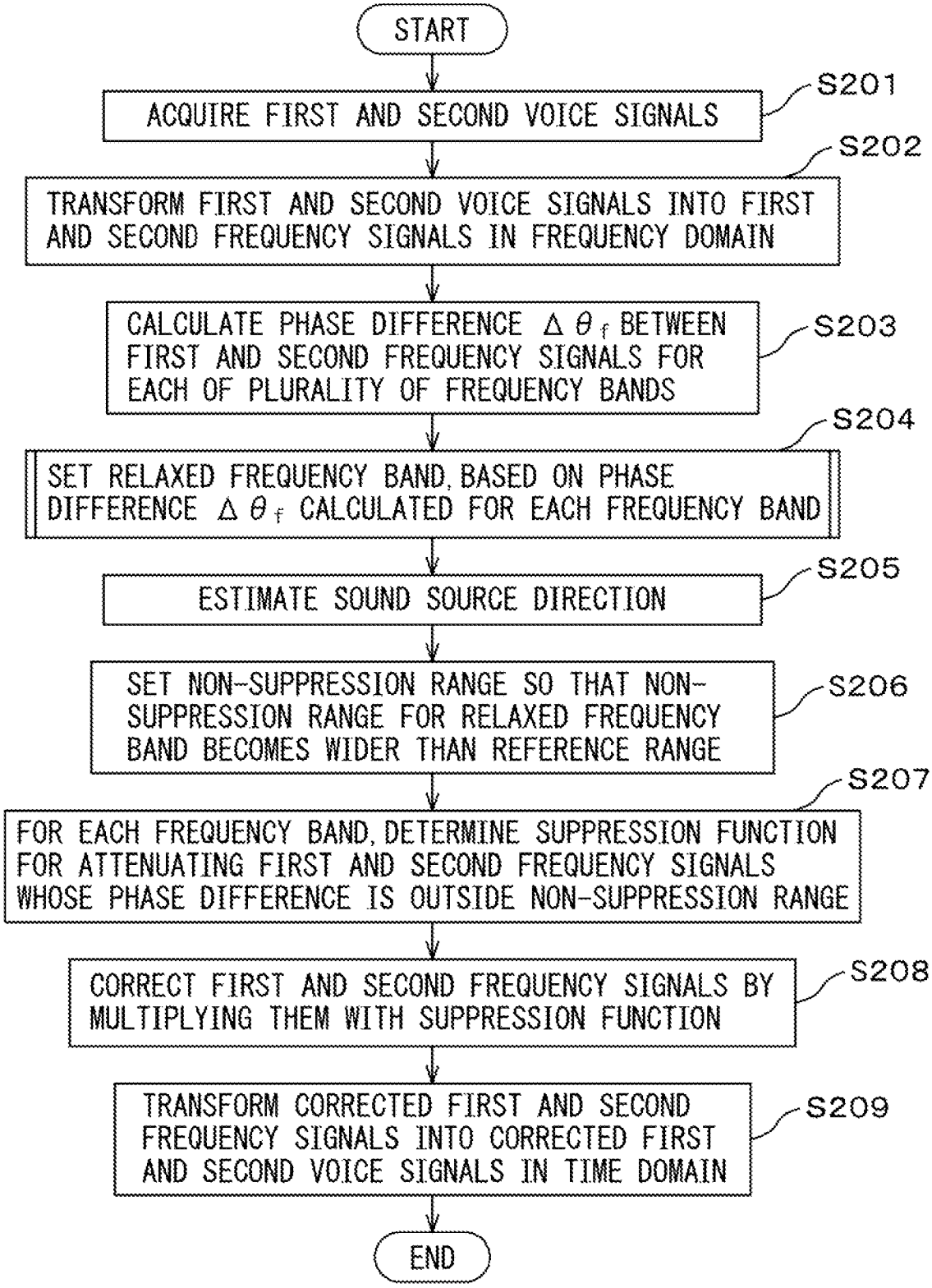
FIG. 10 is an operational flowchart of voice processing.

FIG. 10 is an operational flowchart of the voice processing performed by the voice processing apparatus 6.

The voice processing apparatus 6 acquires the first and second voice signals (step S201). The first and second voice signals are passed to the time-frequency transforming unit 11. The time-frequency transforming unit 11 transforms the first and second voice signals into the first and second frequency signals in the frequency domain (step S202). Then, the time-frequency transforming unit 11 passes the first and second frequency signals to the phase difference calculation unit 12 and the signal correction unit 16.

The phase difference calculation unit 12 calculates the phase difference $\Delta\theta_f$ between the first and second frequency signals for each of the plurality of frequency bands (step S203). Then, the phase difference calculation unit 12 passes the phase difference $\Delta\theta_f$ calculated for each frequency band to the detection unit 13 and the signal correction unit 16.

Based on the phase difference $\Delta\theta_f$ calculated for each frequency band, the detection unit 13 sets the relaxed frequency band (step S204). Further, the detection unit 13 estimates the direction of the sound source (step S205). Then, the detection unit 13 notifies the suppression range setting unit 14 of the relaxed frequency band and the estimated sound source direction.

The suppression range setting unit 14 sets the non-suppression range for each frequency band so that the non-suppression range for the relaxed frequency band becomes wider than the reference range (step S206). The suppression range setting unit 14 notifies the suppression function calculation unit 15 of the set non-suppression range. The suppression function calculation unit 15 determines for each frequency band a suppression function for attenuating the first and second frequency signals whose phase difference is outside the non-suppression range (step S207). The suppression function calculation unit 15 passes the determined suppression function to the signal correction unit 16.

The signal correction unit 16 corrects the first and second frequency signals by multiplying them with the suppression function (step S208). At this time, when the phase difference $\Delta\theta_f$ does not fall within the non-suppression range, the signal correction unit 16 attenuates the first and second frequency signals. Then, the signal correction unit 16 passes the corrected first and second frequency signals to the frequency-time transforming unit 17.

The frequency-time transforming unit 17 transforms the corrected first and second frequency signals into the corrected first and second voice signals in the time domain (step S209). The voice processing apparatus 6 outputs the corrected first and second voice signals, and then terminates the voice processing.

As has been described above, the voice processing apparatus expands the non-suppression range for any frequency band in which the actually measured phase difference differs from the phase difference corresponding to the direction of the target sound source due to the difference in characteristics between the individual voice input units or due to the environment where they are installed. In this way, the voice processing apparatus prevents the sound from the target sound source from distorting and thus the sound is easier to hear.

Next, a voice processing apparatus according to a second embodiment will be described. The voice processing apparatus according to the second embodiment sets the relaxed frequency band based on prior knowledge of the target sound source direction.

The voice processing apparatus according to the second embodiment is incorporated in a voice input system, such as a hands-free car phone, in which the direction of the sound source is known in advance. Alternatively, the voice processing apparatus according to the second embodiment determines the relaxed frequency band for each sub-direction range during calibration, and when performing the voice processing, the voice processing apparatus determines the non-suppression range based on the relaxed frequency band determined during calibration.

The voice processing apparatus of the second embodiment differs from the voice processing apparatus of the first embodiment in the processing performed by the detection unit 13. The following description therefore deals with the detection unit 13. For the other component elements of the voice processing apparatus of the second embodiment, refer to the description earlier given of the corresponding component elements of the voice processing apparatus of the first embodiment.

In the present embodiment, the detection unit 13 receives the direction of the target sound source, for example, from the control unit 7 of the voice input system 1 equipped with the voice processing unit 6. Then, from among the plurality of sub-direction ranges, the detection unit 13 identifies the sub-direction range that contains the direction of the target sound source, and sets it as the attention sub-direction range.

Figure 11:
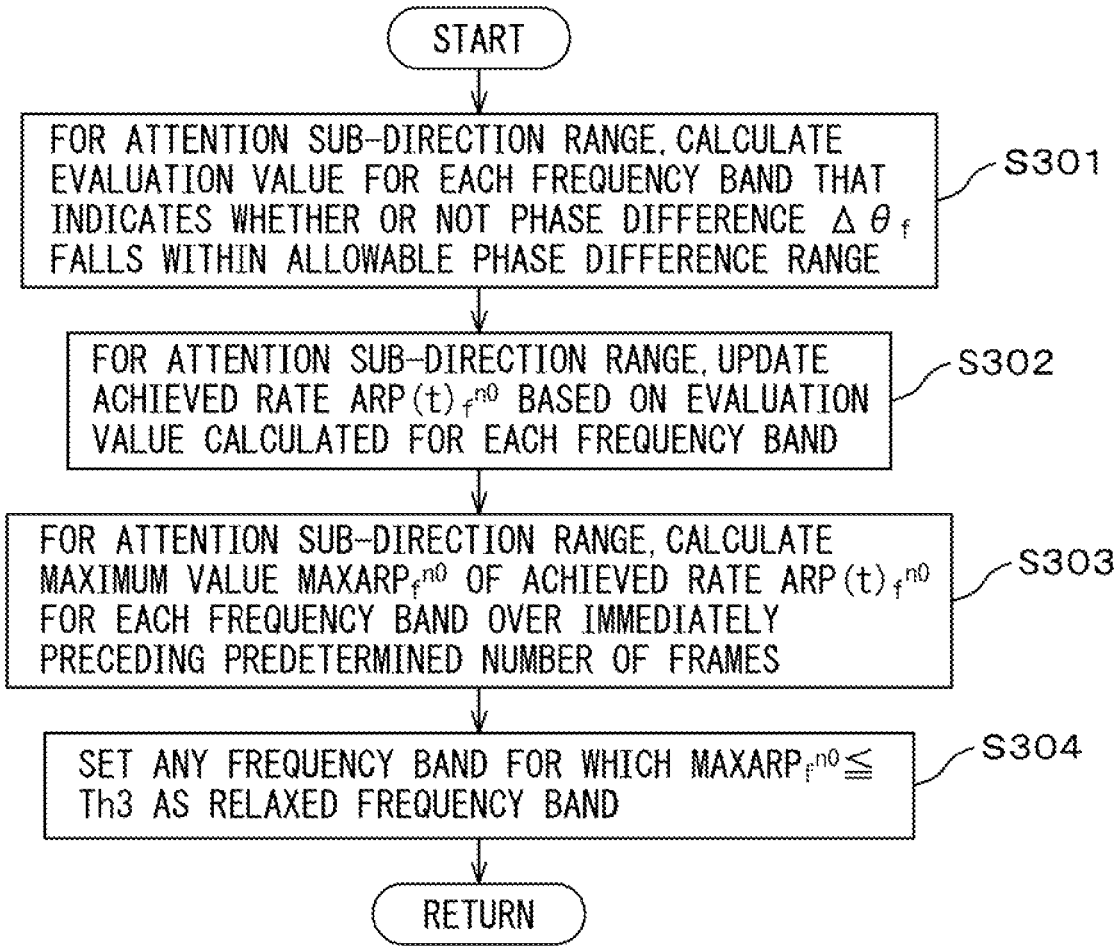
FIG. 11 is an operational flowchart of a relaxed frequency band setting process according to a second embodiment.

FIG. 11 is an operational flowchart of a relaxed frequency band setting process which is carried out by the detection unit 13 in the voice processing apparatus according to the second embodiment.

The detection unit 13 calculates for each frequency band an evaluation value, only for the attention sub-direction range, that indicates whether or not the phase difference $\Delta\theta_f$ falls within the phase difference range (step S301). Then, only for the attention sub-direction range, the detection unit 13 updates the achieved rate $ARP(t)_f^{n0}$ based on the evaluation value calculated for each frequency band (step S302). Here, n0 is an index indicating the attention sub-direction range. Then, for each frequency band, the detection unit 13 calculates the maximum value $MAXARP_f^{n0}$ of the achieved rate over the immediately preceding predetermined number of frames (step S303).

The detection unit 13 compares the maximum value $MAXARP_f^{n0}$ of the achieved rate for each frequency band with a predetermined threshold value Th3, and sets the frequency band as a relaxed frequency band if the maximum value $MAXARP_f^{n0}$ is not larger than the threshold value Th3 (step S304). The threshold value Th3 is set equal to the lower limit value that the achieved rate can take, for example, when a sound from a particular sound source direction has continued for a period corresponding to the number of frames used for the calculation of the achieved rate. The detection unit 13 notifies the suppression range setting unit 14 of the relaxed frequency band for the attention sub-direction range.

The suppression range setting unit 14 sets the non-suppression range for the attention sub-direction range, and the suppression function calculation unit 15 determines the suppression function based on the non-suppression range.

When performing calibration on the voice input system equipped with the above voice processing apparatus, the voice input system may determine the relaxed frequency band for each individual sub-direction range during the calibration. In this case, the signal correction unit 16 may be configured to store the suppression function, determined based on the relaxed frequency band for each individual sub-direction range, in a nonvolatile memory circuit internal to the signal correction unit 16. Then, in the voice processing illustrated in FIG. 10, step 204 may be omitted. Further, in the voice input system equipped with the above voice processing apparatus, when the direction of the target sound source is limited to one particular sub-direction range, step S205 may also be omitted.

According to the above embodiment, since the sound source direction is known in advance when determining the relaxed frequency band, the voice processing apparatus need only obtain the achieved rate only for that sound source direction. Accordingly, the voice processing apparatus can reduce the amount of computation for determining the relaxed frequency band.

In a modified example, when determining the relaxed frequency band, the voice processing apparatus may compare the achieved rate itself with the threshold value Th3, rather than comparing the maximum value of the achieved rate for the attention sub-direction range with the threshold value Th3. The reason is that, in the present embodiment, the variation with time of the achieved rate is small because it is expected that the position of the sound source does not change much with time.

Next, a voice processing apparatus according to a third embodiment will be described. The voice processing apparatus according to the third embodiment determines the relaxed frequency band based on input voice signals only when the percentage of the noise components contained in the voice signals is low.

Figure 12:
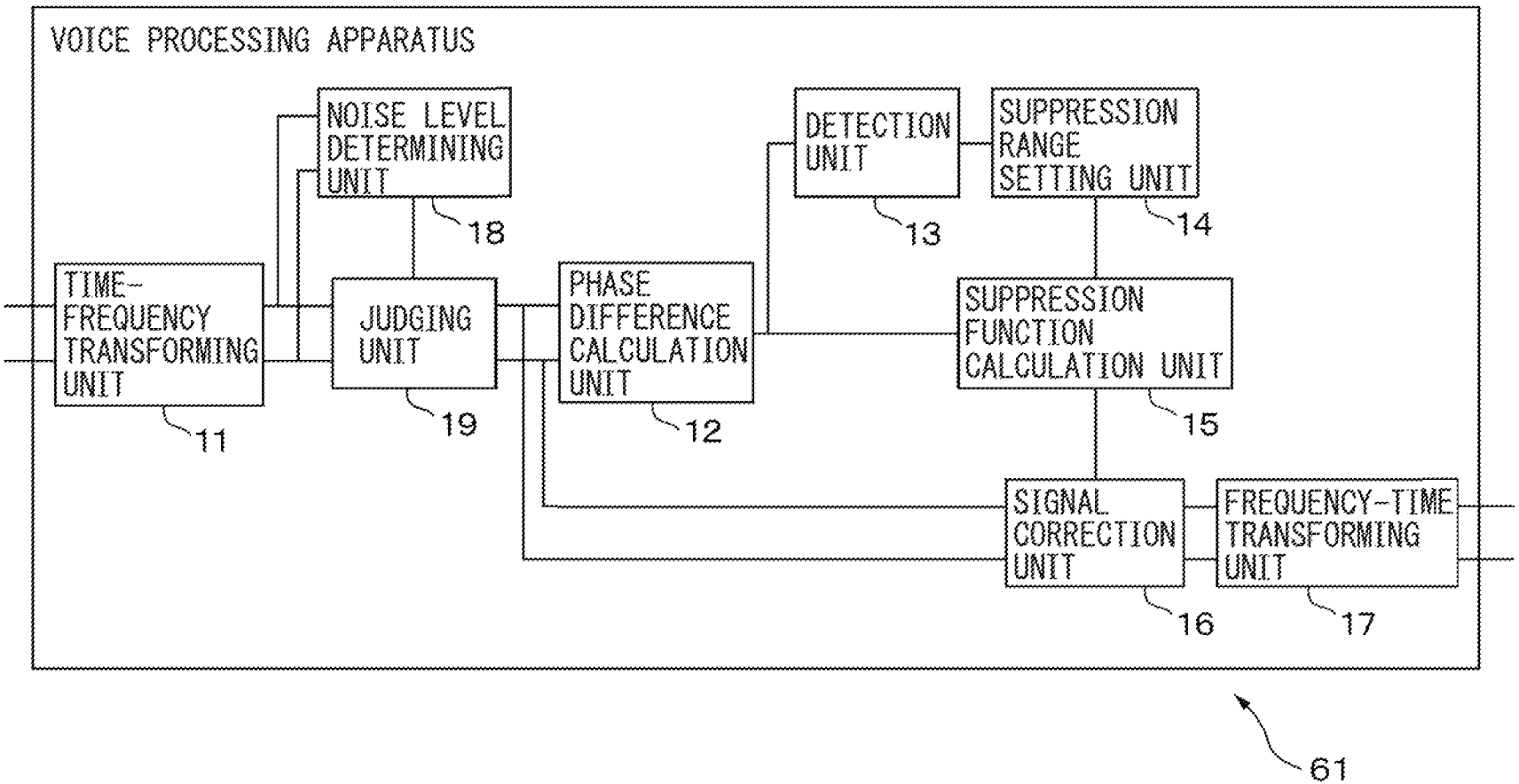
FIG. 12 is a diagram schematically illustrating the configuration of a voice processing apparatus according to a third embodiment.

FIG. 12 is a diagram schematically illustrating the configuration of the voice processing apparatus according to the third embodiment. The voice processing apparatus 61 according to the third embodiment includes a time-frequency transforming unit 11, a phase difference calculation unit 12, a detection unit 13, a suppression range setting unit 14, a suppression function calculation unit 15, a signal correction unit 16, a frequency-time transforming unit 17, a noise level determining unit 18, and a judging unit 19. In FIG. 12, the component elements of the third voice processing apparatus 61 that are identical to those in the voice processing apparatus 6 depicted in FIG. 2 are designed by the same reference numerals as those used in FIG. 2.

The voice processing apparatus of the third embodiment differs from the voice processing apparatus of the first embodiment by the inclusion of the noise level determining unit 18 and the judging unit 19. The following description therefore deals with the noise level determining unit 18 and the judging unit 19. For the other component elements of the voice processing apparatus of the third embodiment, refer to the description earlier given of the corresponding component elements of the voice processing apparatus of the first embodiment.

The noise level determining unit 18 determines the level of noise contained in the first and second voice signals by estimating a stationary noise model based on the voice signals captured by the voice input units 2-1 and 2-2.

Generally, a noise source is located farther away from the voice input unit than the target sound source is. Therefore, the power of the noise component is smaller than the power of the voice arriving from the target sound source. In view of this, for one or the other of the first and second voice signals input to the voice processing apparatus 61, the noise level determining unit 18 calculates an estimate of the noise spectrum of the stationary noise model by obtaining an average power level for each frequency band for a frame whose power spectrum is small.

More specifically, each time the first and second frequency signals for one frame are received from the time-frequency transforming unit 11, the noise level determining unit 18 calculates the average value p of the power spectrum for one or the other of the first and second frequency signals in accordance with the following equation.

$$p = \frac{1}{M}\sum_{f=flow}^{fhigh}(10\log_{10}(s(f)^2)) \tag{4}$$

where M represents the number of frequency bands. Further, $f_{low}$ represents the lowest frequency, and $f_{high}$ the highest frequency. S(f) indicates the first frequency signal or the second frequency signal. The power spectrum may be calculated for whichever of the first and second frequency signals is selected; in the illustrated example, the power spectrum is calculated for the first frequency signal.

Next, the noise level determining unit 18 compares the average value p of the power spectrum for the most recent frame with a threshold value Thr corresponding to the upper limit of the noise component power. The threshold value Thr is set, for example, to a value within the range of 10 dB to 20 dB. Then, when the average value p is smaller than the threshold value Thr, the noise level determining unit 18 calculates an estimated noise spectrum $N_m(f)$ for the most recent frame by averaging the power spectrum in time direction for each frequency band in accordance with the following equation.

$$N_m(f)=\beta\cdot N_{m-1}(f)+(1-\beta)\cdot 10\log_{10}(S(f)^2) \tag{5}$$

where $N_{m-1}(f)$ is the estimated noise spectrum calculated for the frame immediately preceding the most recent frame and is loaded from a buffer provided in the noise level determining unit 18. Further, β is a forgetting coefficient and is set, for example, to a value within the range of 0.9 to 0.99. On the other hand, when the average value p is not smaller than the threshold value Thr, the noise level determining unit 18 does not update the estimated noise spectrum because it is presumed that a component other than noise is contained in the most recent frame. In other words, the noise level determining unit 18 sets $N_m(f)=N_{m-1}(f)$.

Rather than calculating the average value p of the power spectrum, the noise level determining unit 18 may calculate the maximum value of the power spectrum taken over all the frequency bands and may compare the maximum value with the threshold value Thr.

On the other hand, when the noise is white noise, there is no correlation in power spectrum between the frames. In view of this, the noise level determining unit 18 may update the noise level only when the cross-correlation value of the power spectrum taken over all the frequency bands between the most recent frame and the immediately preceding frame is not larger than a predetermined threshold value. The predetermined threshold value is, for example, 0.1.

The noise level determining unit 18 passes the estimated noise spectrum to the judging unit 19. Further, the noise level determining unit 18 stores the estimated noise spectrum for the most recent frame in the buffer provided in the noise level determining unit 18.

Each time the first and second frequency signals for one frame are received, the judging unit 19 judges whether the first and second frequency signals for that frame contain the sound from the target sound source. For this purpose, the judging unit 19 obtains the ratio (p/np) of the average value p of the power spectrum of the first or second frequency signal, for which the estimated noise spectrum has been calculated, to the average value np of the estimated noise spectrum. When the ratio (p/np) is higher than a predetermined threshold value, the judging unit 19 judges that the first and second frequency signals for that frame contain the sound from the target sound source. The judging unit 19 then passes the first and second frequency signals to the phase difference calculation unit 12 and the signal correction unit 16. Then, using the first and second frequency signals from that frame, the voice processing apparatus 61 determines the relaxed frequency band and the non-suppression range, and corrects the first and second frequency signals in accordance with the suppression function appropriate to the non-suppression range, as in the first embodiment.

On the other hand, when the ratio (p/np) is not higher than the predetermined threshold value, the judging unit 19 does not use the first and second frequency signals from the frame to determine the relaxed frequency band and the non-suppression range, because the amount of noise contained in the first and second frequency signals is large. The voice processing apparatus 61 corrects the first and second frequency signals in accordance with the suppression function obtained for the previous frame. Alternatively, for any frame where the ratio (p/np) is not higher than the predetermined threshold value, the voice processing apparatus 61 may not need to correct the first and second frequency signals. The predetermined threshold value is set, for example, to a value within the range of 2 to 5.

According to the above embodiment, since the voice processing apparatus determines the relaxed frequency band and the non-suppression range based on the voice signals taken from a frame where the amount of noise is relatively small, the relaxed frequency band and the non-suppression range can be determined in a more reliable manner.

Next, a voice processing apparatus according to a fourth embodiment will be described. According to the voice processing apparatus of the fourth embodiment, the threshold value Th1 for the average value $AVMAXARP_f$ of the maximum value of the achieved rate calculated by the detection unit as the percentage of the phase difference $\Delta\theta_f$ falling within the phase difference range over the immediately preceding predetermined number of frames is determined based on the distribution of the maximum values of the achieved rates obtained for all the frequency bands.

The voice processing apparatus of the fourth embodiment differs from the voice processing apparatus of the first embodiment in the processing performed by the detection unit 13. The following description therefore deals with the detection unit 13. For the other component elements of the voice processing apparatus of the fourth embodiment, refer to the description given earlier of the corresponding component elements of the voice processing apparatus of the first embodiment.

When the microphones of the first and second voice input units are ideal microphones and are installed in an ideal environment substantially free from reverberations and the like, the phase difference between the first and second voice signals representing the sound from the sound source located in a specific direction fairly well agrees with its theoretical value. In this case, for almost all the frames, the calculated phase difference $\Delta\theta_f$ falls within the phase difference range predefined for the specific sub-direction range containing that specific direction. On the other hand, the calculated phase difference $\Delta\theta_f$ does not fall within the phase difference range predefined for any other sub-direction range. As a result, the achieved rate for that specific sub-direction range is close to 1, while the achieved rate for any other sub-direction range is close to 0. Therefore, when such ideal microphones are installed in the ideal environment, the following relation holds between the maximum and minimum values of the achieved rates calculated for all the frequency bands.

$$\text{Minimum value of achieved rate} \approx (1.0 - \text{Maximum value of achieved rate})$$

However, when the phase difference between the first and second voice signals deviates from its theoretical value because of the difference in characteristics between the individual microphones of the voice input units 2-1 and 2-2 or the environment where the microphones are installed, the achieved rate may drop for all the sub-direction ranges. As a result, the minimum value of the achieved rate may become smaller than (1.0−Maximum value of achieved rate). In this case, the detection unit 13 obtains the maximum value among the achieved rates calculated for all the frequency bands. Then, the detection unit 13 multiplies (1.0−Maximum value of achieved rate) or (1.0−Maximum value of achieved rate) by a coefficient not smaller than 0.8 but smaller than 1.0, and sets the resulting value as the threshold value Th1 for the average value of the maximum value of the achieved rate.

According to the above embodiment, the voice processing apparatus determines, based on the distribution of the achieved rates, the threshold value Th1 for the average value $AVMAXARP_f$ of the maximum value of the achieved rate for identifying the relaxed frequency band. The voice processing apparatus can thus determine the threshold value Th1 in an appropriate manner.

Next, a voice processing apparatus according to a fifth embodiment will be described. According to the voice processing apparatus of the fifth embodiment, the threshold value Th2 for the variance $VMAXARP_f$ of the maximum value of the achieved rate representing the percentage of the phase difference $\Delta\theta_f$ falling within the phase difference range for each sub-direction range is determined based on the distribution of the variance of the maximum values of the achieved rates obtained for all the frequency bands.

The voice processing apparatus of the fifth embodiment differs from the voice processing apparatus of the first embodiment in the processing performed by the detection unit 13. The following description therefore deals with the detection unit 13. For the other component elements of the voice processing apparatus of the fifth embodiment, refer to the description earlier given of the corresponding component elements of the voice processing apparatus of the first embodiment.

As described above, the phase difference between the first and second voice signals may deviate from its theoretical value because of the difference in characteristics between the individual microphones of the voice input units 2-1 and 2-2 or because of the environment where the microphones are installed. The inventor has found that, in such cases, the minimum value of the frequency tends to exist in a set of values not larger than the mode or median of the variance in the distribution of the variance of the maximum value of the achieved rate obtained for each frequency band. The inventor has also found that, in a frequency band having a variance value smaller than the variance corresponding to the minimum value, the phase difference calculated by the phase difference calculation unit varies with time, and the achieved rate tends to drop for all the sub-direction ranges.

In view of the above, the detection unit 13 obtains, on a frame-by-frame basis, the variance of the maximum value $MAXARP_f$ of the achieved rate for each frequency band, and constructs a histogram of the variance. Then, the detection unit 13 identifies the variance value corresponding to the minimum value of the frequency in a set of values not larger than the mode or median of the variance, and sets this variance value as the variance threshold value Th2 for the frame. The detection unit 13 may obtain the distribution of the variance of the maximum value $MAXARP_f$ of the achieved rate for each frequency band not only for one frame but also for a plurality of immediately preceding frames.

In this embodiment also, as in the fourth embodiment, the detection unit 13 may determine the threshold value Th1 for the average value of the maximum value of the achieved rate, based on the distribution of the maximum values of the achieved rates.

According to the above embodiment, the voice processing apparatus determines, based on the distribution of the variance of the maximum value of the achieved rate, the variance threshold value Th2 for the variance $VMAXARP_f$ of the maximum value of the achieved rate for identifying the relaxed frequency band. The voice processing apparatus can thus determine the threshold value Th2 in an appropriate manner.

According to a modified example of each of the above embodiments, the voice processing apparatus may output only one of the first and second voice signals as a monaural voice signal. In this case, the signal correction unit in the voice processing apparatus need only correct one of the first and second voice signals in accordance with the suppression function.

According to another modified example, the signal correction unit may, instead of or in addition to attenuating the first and second frequency signals whose phase difference is outside the non-suppression range, emphasize the first and second frequency signals whose phase difference falls within the non-suppression range.

Further, a computer program for causing a computer to implement the various functions of the processor of the voice processing apparatus according to each of the above embodiments may be provided in the form recorded on a computer readable medium such as a magnetic recording medium or an optical recording medium. The computer readable recording medium does not include a carrier wave.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority and inferiority of the invention. Although the embodiments of the present invention have been described in detail, it should be understood that the various changes, substitutions, and alterations could be made hereto without departing from the spirit and scope of the invention.

What is claimed is:

1. A voice processing apparatus comprising:

a time-frequency transforming unit which transforms a first voice signal representing a sound captured by a first voice input unit and a second voice signal representing a sound captured by a second voice input unit, respectively, into a first frequency signal and a second frequency signal in a frequency domain on a frame-by-frame basis with each frame having a predefined time length;

a phase difference calculation unit which calculates a phase difference between the first frequency signal and the second frequency signal on the frame-by-frame basis for each of a plurality of frequency bands;

a detection unit which determines on the frame-by-frame basis for each of the plurality of frequency bands whether or not the phase difference falls within a first range of phase differences that the phase difference can take for a specific sound source direction, thereby obtaining the percentage of the phase difference falling within the first range over a predetermined number of frames, and which detects, from among the plurality of frequency bands, a frequency band for which the percentage does not satisfy a condition corresponding to a sound coming from the sound source direction;

a range setting unit which sets, for the frequency band detected by the detection unit, a second range by expanding the first range predefined for the sound source direction;

a signal correction unit which produces corrected first and second frequency signals by making the amplitude of at least one of the first and second frequency signals larger when the phase difference falls within the second range than when the phase difference falls outside the second range; and a frequency-time transforming unit which transforms the corrected first and second frequency signals, respectively, into corrected first and second voice signals in a time domain.

2. The voice processing apparatus according to claim 1, wherein the detection unit determines that, of the plurality of frequency bands, any frequency band for which the percentage is not larger than a first threshold value is a frequency band for which the percentage does not satisfy the condition.

3. The voice processing apparatus according to claim 1, wherein, for each of the plurality of frequency bands, the detection unit obtains a maximum value of the percentage taken over the predetermined number of frames for each of a plurality of sound source directions, and determines that, of the plurality of frequency bands, any frequency band for which an average value of the maximum value for each of the plurality of sound source directions is not larger than a second threshold value, and for which the variance of the maximum value for each of the plurality of sound source directions is not larger than a third threshold value, is a frequency band for which the percentage does not satisfy the condition.

4. The voice processing apparatus according to claim 3, wherein the second threshold value is set equal to a lower limit value that the average value can take when a sound from a particular one of the plurality of sound source directions has continued for a period corresponding to the predetermined number of frames.

5. The voice processing apparatus according to claim 3, wherein the third threshold value is set equal to a lower limit value that the variance can take when a sound from a particular one of the plurality of sound source directions has continued for a period corresponding to the predetermined number of frames.

6. The voice processing apparatus according to claim 1, wherein, for the frequency band detected by the detection unit, the range setting unit sets the second range by expanding the first range by not smaller than a maximum value of an amount by which the phase difference deviates from the first range among the predetermined number of frames for the detected frequency band.

7. The voice processing apparatus according to claim 1, wherein the signal correction unit produces the corrected first and second frequency signals by reducing the amplitude of at least one of the first and second frequency signals when the phase difference deviates from the second range.

8. The voice processing apparatus according to claim 1, wherein the signal correction unit produces the corrected first and second frequency signals by increasing the amplitude of at least one of the first and second frequency signals when the phase difference falls within the second range.

9. A voice processing method comprising:

transforming a first voice signal representing a sound captured by a first voice input unit and a second voice signal representing a sound captured by a second voice input unit, respectively, into a first frequency signal and a second frequency signal in a frequency domain on a frame-by-frame basis with each frame having a predefined time length;

calculating a phase difference between the first frequency signal and the second frequency signal on the frame-by-frame basis for each of a plurality of frequency bands;

determining on the frame-by-frame basis for each of the plurality of frequency bands whether or not the phase difference falls within a first range of phase differences that the phase difference can take for a specific sound source direction, thereby obtaining the percentage of the phase difference falling within the first range over a predetermined number of frames;

detecting, from among the plurality of frequency bands, a frequency band for which the percentage does not satisfy a condition corresponding to a sound coming from the sound source direction;

setting, for the detected frequency band, a second range by expanding the first range predefined for the sound source direction;

producing corrected first and second frequency signals by making the amplitude of at least one of the first and second frequency signals larger when the phase difference falls within the second range than when the phase difference falls outside the second range; and transforming the corrected first and second frequency signals, respectively, into corrected first and second voice signals in a time domain.

10. The voice processing method according to claim 9, wherein the detecting the frequency band for which the percentage does not satisfy the condition, determines that, of the plurality of frequency bands, any frequency band for which the percentage is not larger than a first threshold value is a frequency band for which the percentage does not satisfy the condition.

11. The voice processing method according to claim 9, wherein the detecting the frequency band for which the percentage does not satisfy the condition, for each of the plurality of frequency bands, obtains a maximum value of the percentage taken over the predetermined number of frames for each of a plurality of sound source directions, and determines that, of the plurality of frequency bands, any frequency band for which an average value of the maximum value for each of the plurality of sound source directions is not larger than a second threshold value, and for which the variance of the maximum value for each of the plurality of sound source directions is not larger than a third threshold value, is a frequency band for which the percentage does not satisfy the condition.

12. The voice processing method according to claim 11, wherein the second threshold value is set equal to a lower limit value that the average value can take when a sound from a particular one of the plurality of sound source directions has continued for a period corresponding to the predetermined number of frames.

13. The voice processing method according to claim 11, wherein the third threshold value is set equal to a lower limit value that the variance can take when a sound from a particular one of the plurality of sound source directions has continued for a period corresponding to the predetermined number of frames.

14. The voice processing method according to claim 9, wherein, for the frequency band detected, the setting the second range sets the second range by expanding the first range by not smaller than a maximum value of an amount by which the phase difference deviates from the first range among the predetermined number of frames for the detected frequency band.

15. The voice processing method according to claim 9, wherein the producing corrected first and second frequency signals produces the corrected first and second frequency signals by reducing the amplitude of at least one of the first and second frequency signals when the phase difference deviates from the second range.

16. The voice processing method according to claim 9, wherein the producing corrected first and second frequency signals produces the corrected first and second frequency signals by increasing the amplitude of at least one of the first and second frequency signals when the phase difference falls within the second range.

17. A non-transitory computer-readable recording medium having recorded thereon a voice processing computer program for causing a computer to implement:

transforming a first voice signal representing a sound captured by a first voice input unit and a second voice signal representing a sound captured by a second voice input unit, respectively, into a first frequency signal and a second frequency signal in a frequency domain on a frame-by-frame basis with each frame having a predefined time length;

calculating a phase difference between the first frequency signal and the second frequency signal on the frame-by-frame basis for each of a plurality of frequency bands;

determining on the frame-by-frame basis for each of the plurality of frequency bands whether or not the phase difference falls within a first range of phase differences that the phase difference can take for a specific sound source direction, thereby obtaining the percentage of the phase difference falling within the first range over a predetermined number of frames, and detecting, from among the plurality of frequency bands, a frequency band for which the percentage does not satisfy a condition corresponding to a sound coming from the sound source direction;

setting, for the detected frequency band, a second range by expanding the first range predefined for the sound source direction;

producing corrected first and second frequency signals by making the amplitude of at least one of the first and second frequency signals larger when the phase difference falls within the second range than when the phase difference falls outside the second range; and transforming the corrected first and second frequency signals, respectively, into corrected first and second voice signals in a time domain.

18. A voice processing apparatus comprising a processor adapted to:

transform a first voice signal representing a sound captured by a first voice input unit and a second voice signal representing a sound captured by a second voice input unit, respectively, into a first frequency signal and a second frequency signal in a frequency domain on a frame-by-frame basis with each frame having a predefined time length;

calculate a phase difference between the first frequency signal and the second frequency signal on the frame-by-frame basis for each of a plurality of frequency bands;

determine on the frame-by-frame basis for each of the plurality of frequency bands whether or not the phase difference falls within a first range of phase differences that the phase difference can take for a specific sound source direction, thereby obtaining the percentage of the phase difference falling within the first range over a predetermined number of frames, and detect, from among the plurality of frequency bands, a frequency band for which the percentage does not satisfy a condition corresponding to a sound coming from the sound source direction;

set, for the detected frequency band, a second range by expanding the first range predefined for the sound source direction;

produce corrected first and second frequency signals by making the amplitude of at least one of the first and second frequency signals larger when the phase difference falls within the second range than when the phase difference falls outside the second range; and transform the corrected first and second frequency signals, respectively, into corrected first and second voice signals in a time domain.

* * * * *